United States Patent [19]

Ishii

[11] Patent Number: 4,857,899

[45] Date of Patent: Aug. 15, 1989

[54] IMAGE DISPLAY APPARATUS

[75] Inventor: Takatoshi Ishii, Tokyo, Japan

[73] Assignee: ASCII Corporation, Tokyo, Japan

[21] Appl. No.: 940,530

[22] Filed: Dec. 10, 1986

[30] Foreign Application Priority Data

Dec. 10, 1985 [JP] Japan ..... 60-277364
Jan. 28, 1986 [JP] Japan ..... 61-16350
Feb. 20, 1986 [JP] Japan ..... 61-35537

[51] Int. Cl.[4] ..... G09G 1/28

[52] U.S. Cl. ..... 340/701; 340/703; 340/721; 340/728

[58] Field of Search ..... 340/701, 702, 703, 750, 340/798, 721, 723, 724, 728; 358/28, 168

[56] References Cited

U.S. PATENT DOCUMENTS

| | | | |
|---|---|---|---|
| 4,278,973 | 7/1981 | Hughes et al. | 340/721 |
| 4,649,380 | 3/1987 | Penna | 340/703 |
| 4,651,146 | 3/1987 | Lucash et al. | 340/750 |
| 4,673,929 | 6/1987 | Nelson et al. | 340/703 |
| 4,677,427 | 6/1987 | Komaksu et al. | 340/750 |
| 4,695,835 | 9/1987 | Bugg | 340/750 |
| 4,724,431 | 2/1988 | Holtey et al. | 340/703 |

*Primary Examiner*—David K. Moore

*Assistant Examiner*—M. Fatahiyar

*Attorney, Agent, or Firm*—Hoffmann & Baron

[57] ABSTRACT

An image display apparatus reads color data and attribute data accompanied with the color data from a RAM of a look-up table (LUT) in accordance with each color code read from a video memory (VRAM). The read color data is subjected to a data modification determined by the read attribute data, and a color of each display dot is determined in accordance with the color data obtained as the result of the data modification. According to this image display apparatus, an image and the color thereof can be displayed without storing all the color codes of the image into the VRAM, so that the load on the CPU can be reduced and the image can be displayed at a high speed. The LUT can be omitted by storing, correspondingly to each display dot, display data composed of color data and attribute data in the VRAM. The circuit for effecting the data modification may comprise a plurality of registers and an operation circuit for effecting an operation on data contained in the registers. In this case, the registers and the operation circuit are controlled in accordance with the read attribute data to obtain various display effects such as Gouraud Shading and Phong Shading.

15 Claims, 23 Drawing Sheets

IMAGE DISPLAY APPARATUS

FIELD OF THE INVENTION

The present invention relates to an image display apparatus in which an image is displayed in color on a cathode-ray tube display unit under control of a central processing unit (CPU).

Prior Art

Various image display apparatus have heretofore been used to display a colored image on a cathode-ray tube (CRT) display unit under control of a CPU. In a typical image display apparatus, a color code is previously stored in a video random access memory (hereinafter referred to simply as "VRAM") in correspondence with each dot to be displayed. When a color image is to be displayed on the CRT display unit, these color codes are read from the VRAM, and are converted into color data representative of R (red), G (green) and B (blue) with reference to a color look-up table (hereinafter referred to simply as "LUT"). The thus-obtained color data are further converted into R, G and B color video signals (analog signals), and thus are output to the CRT color display unit together with synchronizing signals.

In another prior-art image display apparatus, a set of R (red) color data, G (green) color data and B (blue) data is previously stored in a VRAM in correspondence with each dot to be displayed. When a colored image is to be displayed, these color data are read from the VRAM and are converted into the R, G and B color video signals (analog signals), thus being output to a CRT color display unit together with synchronizing signals.

However, in such conventional types of image display apparatus, since the color codes or color data within the VRAM are merely converted into R, G and B color video signals for output purposes, the number of display scales is limited. Therefore, as an example, when shading is to be performed, it has been necessary to carry out a special processing by means of a CPU. When a displayed image needs to be varied, it has been necessary to rewrite all the color codes or color data within the VRAM by means of the CPU. Accordingly, the prior-art apparatus have disadvantage in that the time required for this rewriting is long and a CPU must undertake a large number of tasks as well as it is impossible to update displayed image at high speed.

If 8 bits are assigned to each of the above-mentioned R, G and B color video signals, an image can be displayed in $2^8 \times 2^8 \times 2^8 = 2^{24}$ colors, thereby enabling a remarkably colorful image to be displayed. In this case, however, there is a disadvantage in that a VRAM requires a large capacity. On the other hand, if 4 bits are assigned to each of the R, G and B color video signals, the capacity of the VRAM can be reduced by half, but the number of colors then decreases to $2^4 \times 2^4 \times 2^4 = 2^{12}$ colors. In this sense, prior-art image display apparatus have involved disadvantage in that, when the number of colors is to be increased, the capacity of the VRAM is necessarily enlarged.

SUMMARY OF THE INVENTION

It is therefore an object of the present invention to provide an image display apparatus in which a colorful image can be displayed, and yet which is capable of reducing the load on a CPU as compared with the prior art.

It is another object of the present invention to provide an image display apparatus in which a displayed image can be varied at high speed, and in which the time required for the production of software can be greatly shortened since the processing of software is made simple.

It is a further object of the present invention to provide an image display apparatus in which the number of display colors can be increased without increasing the capacity of a VRAM.

Accordingly, the present invention provides an image display apparatus used in combination with a color display unit for displaying on a screen thereof an image composed of a multiplicity of displayed dots, each exhibiting its color determined on the basis of supplied color signals, such an image display apparatus comprising:

(a) storage means for storing a plurality of sets of display data including: color data associated with the color of each of the dots to be displayed; and attribute data representative of the attribute of the color data;

(b) readout means for selectively reading the plurality of sets of display data from the storage means in accordance with a timing at which each of the dots is displayed on the color display unit;

(c) data modifier means for performing data-modifying operations on the color data contained in the thus-read display data, in accordance with the attribute data contained in the same, thus supplying the result of the data-modifying operations; and (d) signal supplying means for supplying an output of the data-modifying means to the color display unit in the form of the color signal.

DESCRIPTION OF THE PREFERRED EMBODIMENTS OF THE INVENTION

Preferred embodiments of the invention will be described below with reference to the accompanying drawings.

I First embodiment

FIG. "1" is a block diagram of the construction of a color display system arranged to display an image in a dotted manner by means of the image display apparatus 100 constituting the first preferred embodiment of the present invention. The following description concerns the details of such a display system.

I-1 Diagrammatic construction

Figure 1:
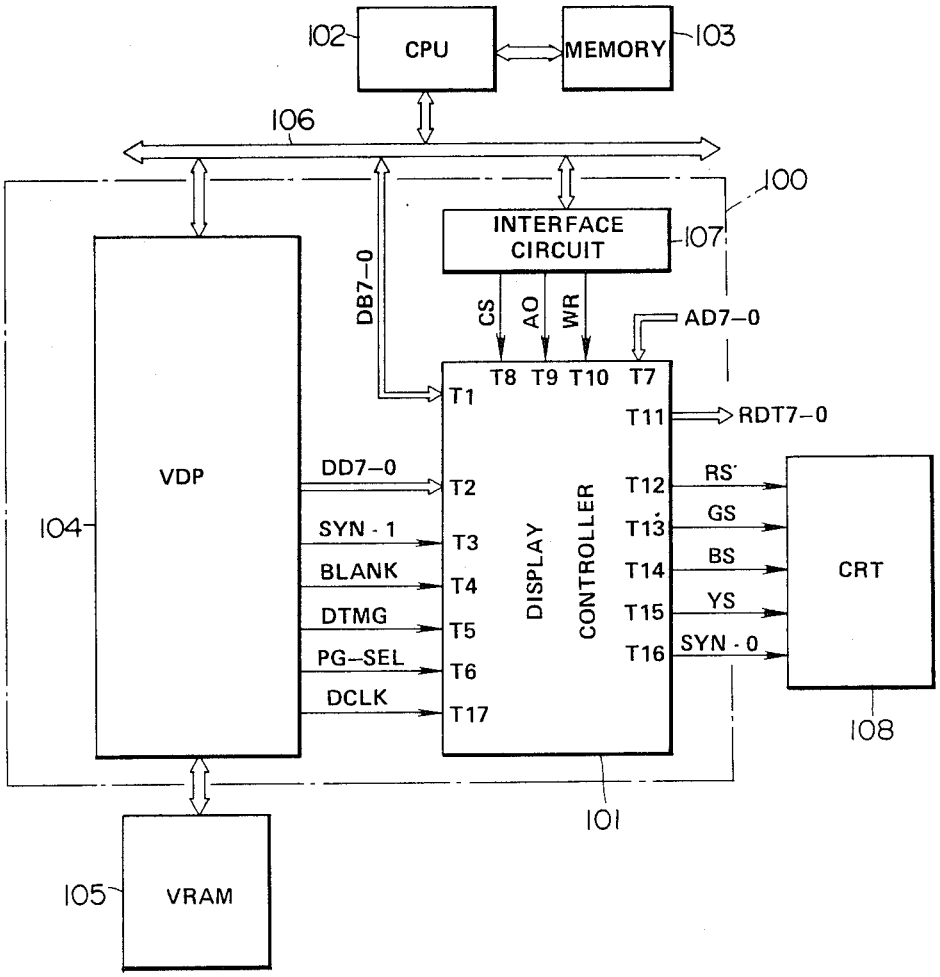
FIG. 1 is a block diagram of a display system which incorporates an image display apparatus 100 constituting a first preferred embodiment of the present invention.

The display system shown in FIG. 1 includes: a display controller 101; a CPU 102; a memory 103 having a ROM (read only memory) for storing program and a RAM (random access memory) for storing data, such program and data being used in the CPU 102; a video display processor 104 (hereinafter referred to simply as "VDP"); a VRAM 105; an interface circuit 107; a CRT display unit 108; and other connection circuitry. The VDP 104 is supplied with color codes by the CPU 102 via a bus line 106 and writes them into the VRAM 105. In addition, the VDP 104 reads these color codes from the VRAM 105, and sequentially outputs them to the display controller 101 in the form of 8-bit dot data DD7-0. The VDP 104 further outputs a synchronizing signal SYN·I, a blanking signal BLANK, a display timing signal DTMG, a page select signal PG-SEL and a dot clock DCLK to the display controller 101. The synchronizing signal SYN I provides synchronism for the displaying operation of the CRT display unit 108. The blanking signal BLANK is a signal which assumes the "1" state during a later-described screen displaying period while it assumes the "0" state during other period. The display timing signal DTMG assumes the "1" state during a later-described image displaying period while it assumes the "0" state during other period. The screen displaying period differs from the image displaying period. Specifically, the screen is generally divided into those regions in which an image is displayed and in which a border is displayed, the image only being displayed in the former image displaying region while the border region is displayed in a single color. The image displaying period is the period during which the image displaying region is scanned, whereas the screen displaying period is the period during which the screen (both of the image displaying region and the border region) is scanned. The page select signal PG-SEL is a signal which repeats the "1" state and the "0" state, for example, every 0.5 seconds, and the dot clock DCLK is a signal representative of the timing at which each dot is displayed on the screen. The interface circuit 107 is a circuit for connecting the CPU 102 and the display controller 101. The display controller 101 converts the dot data DD7-0 supplied from the VDP 104 into R, G and B color data. Subsequently, the controller 101 converts the thus-obtained R, G and B color data into three kinds of analog signals: a red color video signal RS; a green color video signal GS and a blue color video signal BS, and outputs them to the CRT display unit 108. The display controller 101 also outputs a signal YS and a synchronizing signal SYN·O to the CRT display unit 108. A terminal T1 of the controller 101 is connected directly to a data bus DB7-0 extending from the CPU 102. The CRT display unit 108 is a color display unit having the same functions as those of a television reciever. When the signal YS supplied from the display controller 101 is a "1" signal, a visual color display is produced on the basis of the red color signal RS, the green color signal GS, the blue color signal BS and the synchronizing signal SYN.O, such signals being supplied from the controller 101; whereas, when the signal YS is a "0" signal, an image is displayed on the basis of a television signal.

I-2 Detailed construction of display controller 101

Figure 2:
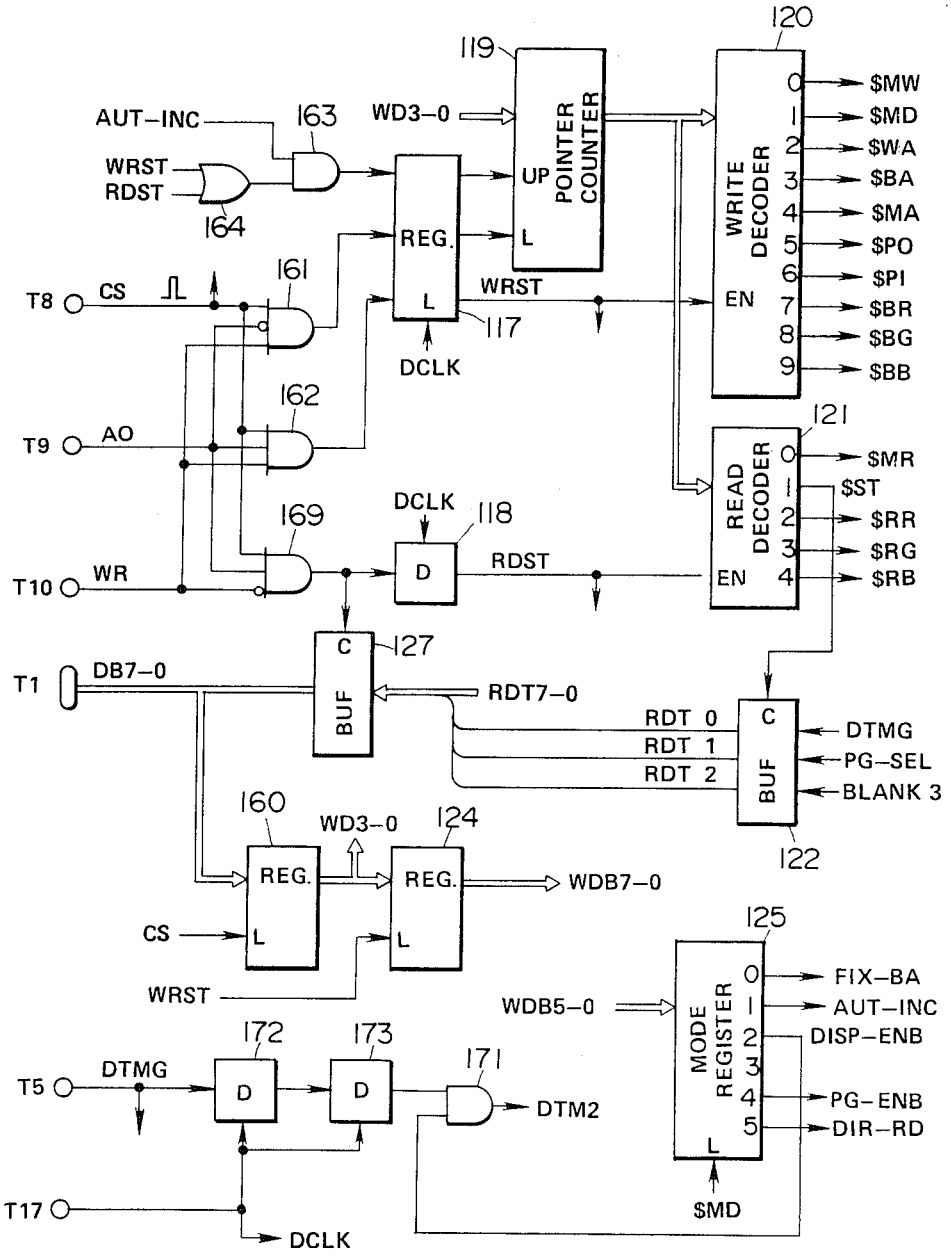
FIG. 2 is a logic diagram of the control section of a display controller 101 forming part of the image display apparatus 100 shown in FIG. 1.
Figure 3:
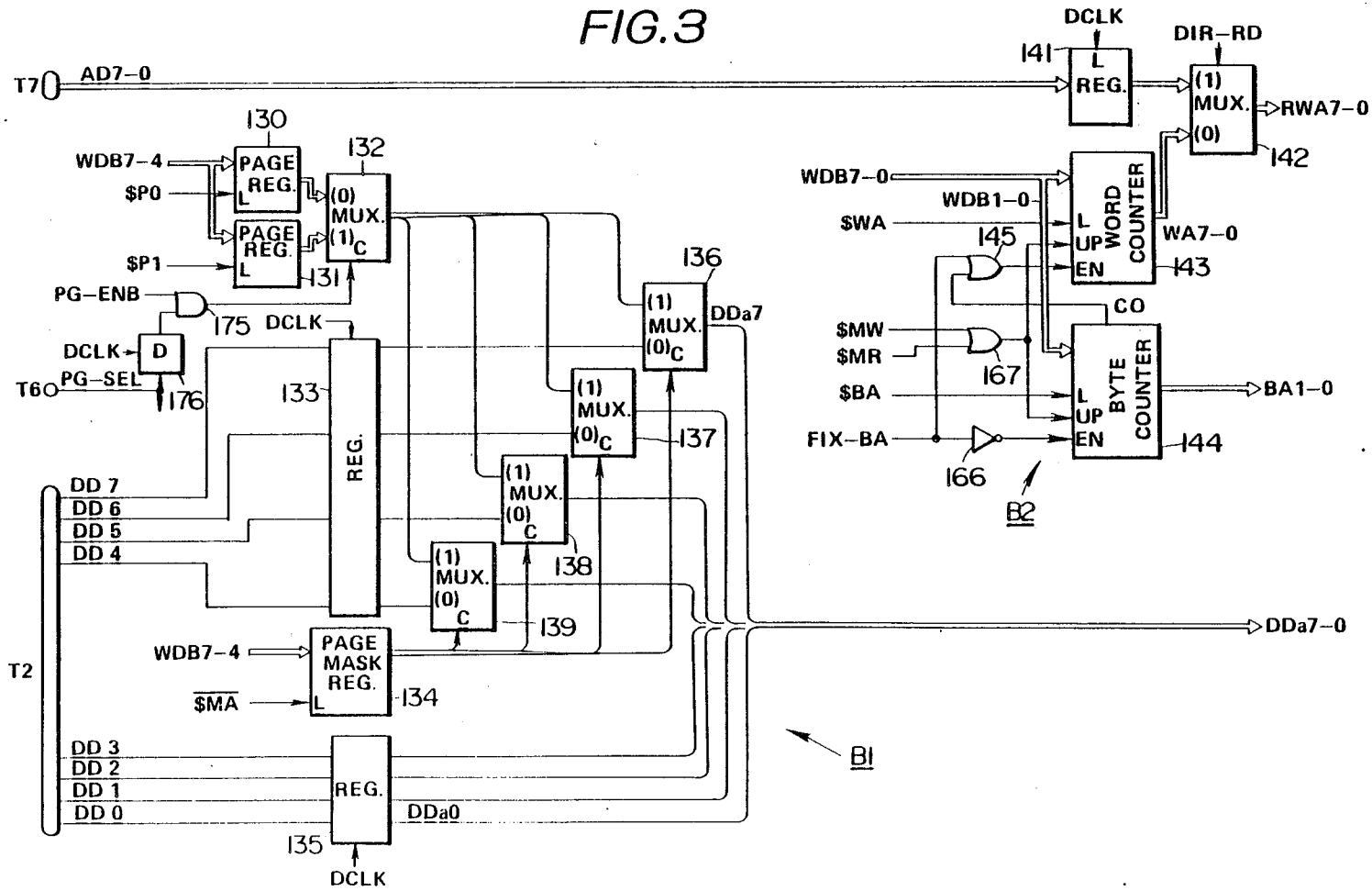
FIG. 3 is a logic diagram of the RAM-address generating section of the display controller 101 shown in FIG. 1.
Figure 4:
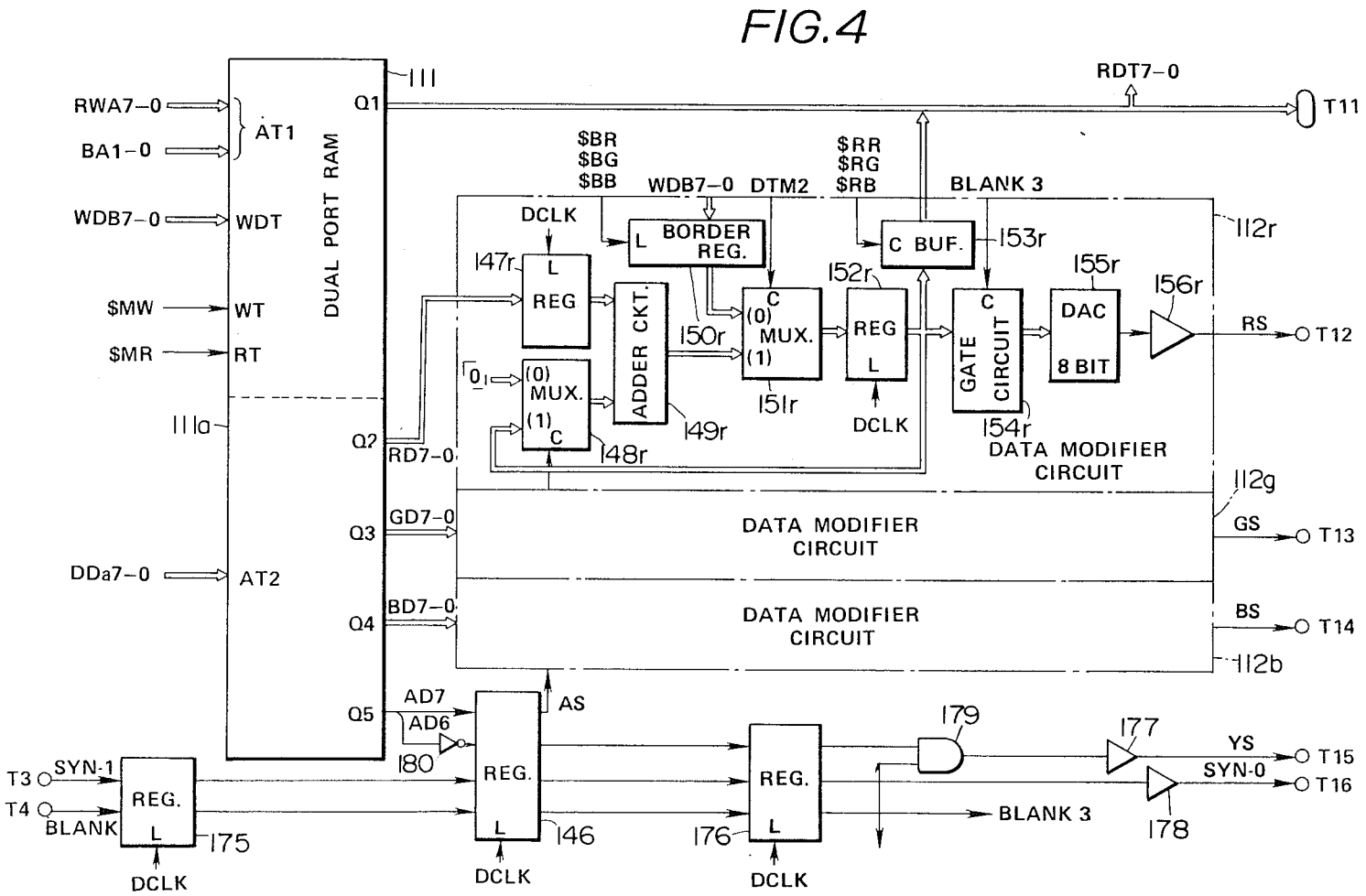
FIG. 4 is a logic diagram of a dual port RAM 111 and data modifier circuits 112*r*, 112*g* and 112*b* which are disposed within the display controller 101 shown in FIG. 1.

FIGS. 2, 3 and 4 are respectively circuit diagrams of the display controller 101. The display controller 101 includes the following major sections: the control section shown in FIG. 2; the RAM-address generating section shown in FIG. 3; and a dual port RAM 111 and color data converter circuits 112*r*, 112*g* and 112*b*, as shown in FIG. 4. The construction of each of these sections will be described below in that order, and their operations will be described in detail later.

I-2-1 Control section (FIG. 2)

The control section primarily controls transmission and reception of data between the CPU 102 and the display controller 101. As shown in FIG. 2, a 3-bit register 117 reads input data on the basis of the dot clock DCLK supplied to a load terminal L of the register 117, and outputs the data through its output terminals. The register 117 is a register for providing synchronism. More specifically, the clock pulse supplied by the CPU 102 is not synchronized with the dot clock DCLK output from the VDP 104. Therefore, the signal and data which are synchronized with the clock pulse from the CPU 102 must be converted into a signal and data in synchronism with the dot clock DCLK. The register 117 is disposed for this purpose. A DFF (D type flip-flop) 118 shown below the register 117 in FIG. 2 is also disposed for the same purpose as described above. A pointer counter 119 is a 4-bit up counter which counts up the signals supplied to an up terminal UP and also reads WD3-0 when a signal is supplied to its load terminal L. Incidentally, the data WD3-0 includes lower-order 4 bits of the output from a register 160 shown below in FIG. 2. A write decoder 120 decodes the output from the pointer counter 119, and, solely at the time when a write strobe WRST is supplied to an enable terminal EN of the decoder 120, the decoder 120 assumes the enable state and thus outputs the results of decoding in the form of strobe signals $MW to $BB. Similarly, a read decoder 121 decodes the output from the pointer counter 119, and, soley at the time when a read strobe RDST is supplied to an enable terminal EN of the decoder 121, the decoder 121 outputs the results of decoding in the form of strobe signals $MR to $RB. Buffers 122 and 127 have control terminals C, respectively. When the control terminals C are respectively supplied with a "1" signal, the buffers 122 and 127 output their input data in the last state through the associated output terminals. When the terminals C are respectively supplied with a "0" signal, the respective output terminals assume a high-impedance state. The line DB7-0 connecting the buffer 127 and the terminal T1 is an 8-bit bidirectional bus. When the load terminal L of the register 160 is supplied with a signal CS, the register 160 reads the data provided at the terminal T1, that is, the data transferred from the CPU 102 through the data bus DB7-0, and the data thus obtained is output to the register 124. When the load terminal L of the register 124 is supplied with the write strobe WRST, the register 124 reads the data output from the register 160, thus outputting this data in the form of data WDB7-0. A mode register 125 is a 6-bit register which reads data WDB5-0 (the lower-order 6 bits of the data WDB7-0) when its load terminal L is supplied with the strobe signal $MD.

I-2-2 RAM-address generating section (FIG. 3)

The RAM-address generating section includes a circuit assembly B1 in which the dot data (or color code) DD7-0 is converted into new dot data DDa7-0 and another circuit assembly B2 for generating address data RWA7-0 (8 bits) and BA1-0 (2 bits). The data DDa7-0 is supplied to an address terminal AT2 of the dual port RAM 111 shown in FIG. 4, while the data RWA7-0, BA1-0 are supplied to an address terminal AT1 of the RAM 111.

The circuit assembly B1 includes 4-bit page registers 130, 131 and a multiplexer 132. The multiplexer 132 outputs the data provided at its input terminal <I> when its control terminal C is supplied with a "1" signal, while, when the terminal C is supplied with a "0" signal, the multiplexer 132 outputs the data provided at its input terminal <0>. The circuit assembly B1 further includes a synchronizing register 133, a 4-bit page mask register 134, a synchronizing register 135 and multiplexers 136 to 139.

The circuit assembly B2 includes a synchronizing register 141, a multiplexer 142, a word counter 143 and a byte counter 144. The counters 143 and 144 read data WDB7-0 and WDB1-0, respectively, when their load terminals L are respectively supplied with a "1" signal. When their enable terminals EN are supplied with "1" signals, the respective counters 143 and 144 count up the signals provided at their up terminal UP. A carry out signal CO of the byte counter 144 is supplied to an input terminal of an OR gate 145.

Figure 5:
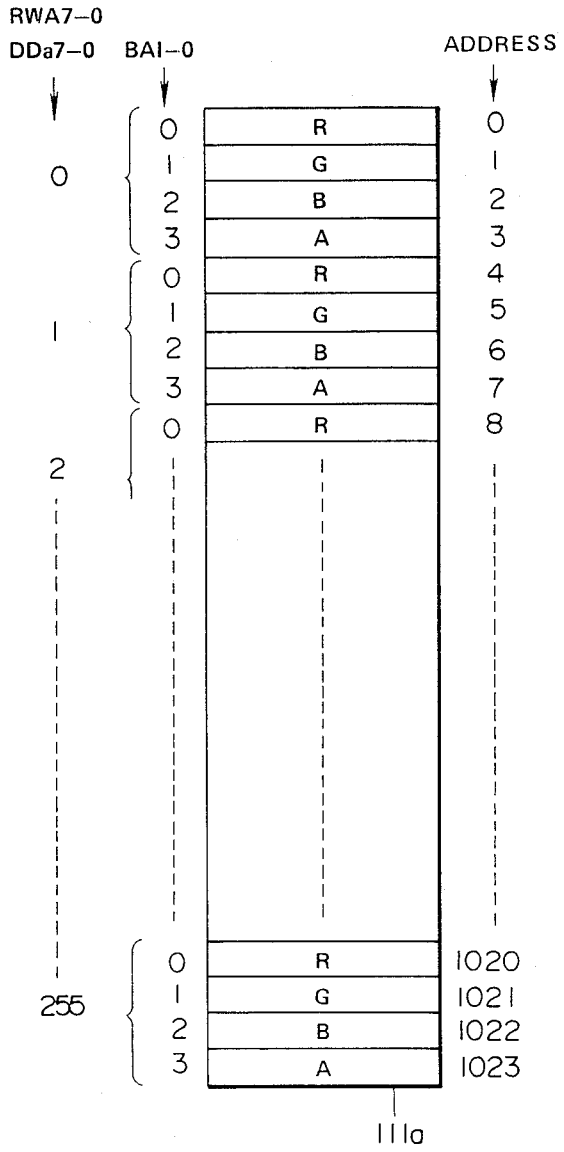
FIG. 5 schematically shows the arrangement of the data stored within a RAM 111 shown in FIG. 4.

I-2-3 Dual port RAM 111 (FIGS. 4 and 5)

The dual port RAM 111 is used as an LUT adapted to convert color codes into color data, which includes a 1024-byte RAM 111*a* and associated peripheral circuitry. Referring to FIG. 5 showing the construction of the RAM 111*a*, R, G and B color data and attribute bit data A corresponding to a color code "0" are stored respectively in 8-bit form at addresses 0 to 3 of the RAM 111*a*. R, G and B color data and attribute data A corresponding to a color code "1" are respectively stored in 8-bit form at addresses 4 to 7 of the RAM 111*a*. This arrangement of data is repeated with regularity until the last color code 255 is reached. Similarly, R, G and B color data and attribute bit data A corresponding to a color code "255" are respectively stored in 8-bit form at addresses 1020 to 1023 of the RAM 111*a*. On the basis of the dot data DDa7-0 (or color code) supplied to the address terminal AT2 of the dual port RAM 111, a corresponding set of R, G and B color data and attribute bit data A are read out, with the color data R, G and B respectively being output through the output terminals Q2, Q3 and Q4 of the RAM 111*a* in the form of color data RD7-0, GD7-0 and BD7-0 while the attribute bit data A is output through the output terminal Q5 of the RAM 111*a*. In this case, seventh and sixth bits of the attribute bit data A are output as attribute data AD7 and AD6. Fifth to zeroth bits of the attribute bit data A are not used in the first preferred embodiment. The function of the attribute bit data A will be described later in detail.

In this fashion, the dual port RAM 111 shown in FIG. 4 reads out the R, G and B color data and the attribute bit data A when the dot data DDa7-0 is applied to its address terminal AT2. In addition, the writing/reading of the RAM 111*a* can be effected in a unit of bytes, completely independent of the above-described reading. Specifically, when 10-bit address data, 8-bit data, and a pulse signal are respectively applied to the address terminal AT1, a data terminal WDT and a write terminal WT of the dual port RAM 111, data is written into the address of the RAM 111*a* which is specified by the above-described address data. On the other hand, when address data and a pulse signal are respectively applied to the address terminal AT1 and a read terminal RT, data is read out of the address of the dual port RAM 111 which is specified by the above-described address data, and is output through the output terminal Q1 of the dual port RAM 111. The above-mentioned address data RWA7-0 and BA1-0 speficify addresses at which the above-described reading/writing of data is effected. The address data RWA7-0 is applied to the higher-order 8 bits of the address terminal AT1 while the address data BA1-0 is applied to the lower-order 2 bits of the address terminal AT2.

I-2-4 Data modifier circuits 112*r*, 112*g* and 112*b* (FIG. 4)

The data modifier circuits 112*r*, 112*g* and 112*b* have the same construction as one another. The color data RD7-0, GD7-0 and BD7-0 from the RAM 111*a* are modified in response to the attribute signal AS supplied from the register 146, and the data thus modified are respectively converted into analog signals, thus being output as color signals RS, GS and BS. The attribute signal AS is a signal derived from the attribute data AD7 which is delayed by one-dot-clock time by means of the register 146.

The data modifier circuit 112*r* includes a register 147*r* for outputting the color data RD7-0 after delaying the data RD7-0 by one-dot-clock time, a multiplexer 148*r* controlled by the attribute signal AS, an adder circuit 149*r*, a border register 150*r* for holding the color data which determines the color of the border region, a multiplexer 151*r*, a register 152*r* for delaying the output of the multiplexer 151*r* by one-dot-clock time, a buffer 153*r*, a gate circuit 154*r* and a digital/analog converter (DAC) 155*r*. The gate circuit 154*r* is opened when its control terminal C is supplied with a "1" control signal, while, when the terminal C is supplied with a "0" signal, the circuit 154*r* is closed. The output from the digital/analog converter (DAC) 155*r* is supplied via an amplifier 156*r* in the form of the color signal RS.

I-3 Operation of display controller 101

I-3-1 Operation of display controller 101 when data is written thereinto by CPU 102

Prior to display processing, the CPU 102 writes data into each register within the display controller 101 and into the dual port RAM 111. During this writing, the write decoder 120 (FIG. 2) outputs any strobe signals $MW to $BB. A register number is allocated to each of the RAMs, the registers and the counters. The relationship between the register numbers, the strobe signals and the registers into which data is written is as follows:

| | |
|---|---|
| 0 | $MW . . . dual port RAM 111 (FIG. 4) |
| 1 | $MD . . . mode register 125 (FIG. 2) |
| 2 | $WA . . . word counter 143 (FIG. 3) |
| 3 | $BA . . . byte counter 144 (FIG. 3) |
| 4 | $MA . . . page mask register 134 (FIG. 3) |
| 5 | $P0 . . . page register 130 (FIG. 3) |
| 6 | $P1 . . . page register 131 (FIG. 3) |
| 7 | $BR . . . border register 150r (FIG. 4) |
| 8 | $BG . . . border register 150g (FIG. 4) |
| 9 | $BB . . . border register 150b (FIG. 4) |

The operation during a writing operation will be described below. Two addresses as port address are assigned to the interface 107 (FIG. 1), and these two addresses will hereinafter be called "port addresses PA0 and PA1".

(i) Operation of separate writing of data into register

This operation concerns the operation by which data is written into any one of the above-listed registers 125 to 150*b*. In this operation, the CPU 102 first outputs the port address PA0 to the address bus of the bus line 106, then outputting the corresponding register number to the data bus of the bus line 106, and supplying a write pulse to the bus line 106. (This processing is hereinafter referred to as "first processing"). When the port address PA0 is output, the interface 107 detects this output and generates a signal AO representative of "0". Subsequently, when the write pulse is output by the CPU 102, the interface 107 detects this output, thus generating a read/write signal WR representative of "1" and at the same time a pulse signal CS at the same timing as the write pulse supplied from the CPU 102. When the pulse signal CS is output from the interface 107, the signal CS is supplied to the load terminal L of the register 160 (FIG. 2). In response to this signal CS, the register 160 reads the register number supplied along the data bus DB7-0, supplying it to an input terminal of the pointer counter 119. On the other hand, when the value of the signal AO goes to a "0" and that of the signal WR goes to a "1", the AND gate 161 (FIG. 2) is opened and the pulse signal CS is applied to the load terminal L of the pointer counter 119 via an AND gate 161 and the synchronizing register 117. In response to this signal input, the register number held by the register 160 is read out by the pointer counter 119, and then output to the write decoder 120.

Subsequently, the CPU 102 outputs the port address PA1 to the address bus of the bus line 106, then supplying the data to be written into the display controller 101 to the data bus of the same, and outputting a write pulse to the bus line 106. (This processing is hereinafter referred to as "second processing"). The interface 107 outputs the signal AO representative of "1" in response to the port address PA1, and in addition, in reponse to the write pulse, the interface 107 outputs the read/write signal WR representative of "1" and at the same time the pulse signal CS. When the pulse signal CS is supplied by the interface 107, the register 160 reads the data supplied along the data bus DB7-0. When both of the signals AO and WR go to "1"s, an AND gate 122 is opened, and the signal CS is output as the write strobe WRST via the AND gate 162 and the register 117. In response to this write strobe WRST, the register 124 reads data out of the register 160, and the read data is supplied to each of the registers 125 to **150*b*. While the write strobe WRST is being output, the write decoder 120 is set to an enable state and outputs the signals $MW to $BB in correspondence with any output of the pointer counter 119. In response to this signal output, the register or registers of the registers 125 to 150*b* which receives the above-mentioned strobe signal reads data out of the register 124**.

(ii) Operation of continuous writing of data into a plurality of registers

This operation concerns the operation by which data are continuously written into a plurality of the registers 125 to **150*b*. In this operation, in accordance with the processing described above in (i), the CPU 102 first writes data into the mode register 125 (FIG. 2) so that a first bit of the register 125 goes to a "1". In response to this signal input, a signal AUT-INC output from the register 125 assumes the "1" state, and the "1" signal thus obtained is supplied to the AND gate 163 (at the upper left in FIG. 2), thereby opening the gate 163. Subsequently, when date is to be written into, for example, each of the registers 134 to 150*b* corresponding to the register numbers 4 to 9, the CPU 102 writes data into the register 134 corresponding to the register number 4. At the time when the writing is completed in accordance with the processing set forth in the preceding (i), the register number 4 is held in the pointer counter 119. Next, the CPU 102 performs the second processing described in the above (i), that is, outputs the port address PA1, data to be written into the register 130 corresponding to the register number 5 and a write pulse. In response to this signal output, the interface 107 outputs "1"s as the signal AO and WR and at the same time the pulse signal CS, so that in response to the pulse CS, the register 160 reads the above-described data. Subsequently, when the write strobe WRST is supplied to the register 124, the register 124 reads data out of the register 160 in response to the write strobe WRST. On the other hand, the write strobe WRST is supplied to the up terminal UP of the pointer counter 119 through the OR gate 164, the AND gate 163 and the register 117. Therefore, the content of the pointer counter 119 is incremented to render the count output "5", and the count output "5" is supplied to the write decoder 120. In consequence, the write decoder 120 outputs the strobe signal $PO at the timing provided by the write strobe WRST. In response to the strobe signal $PO, the register 130 (FIG. 3) reads date out of the register 124**.

The CPU 102 sequentially outputs data to be written into the registers 131, **150*r*, 150*g* and 150*b* in accordance with the second processing described previously, so that such data are sequentially written into the respective registers 131, 150*r*, 150*g* and 150*b*** in the same manner as described above.

(iii) Operation of separate writing of data into RAM **111*a***

This operation concerns the operation by which data is to be written into any one of the addresses within the RAM **111*a*. In this operation, the CPU 102 first writes a "0" into a fifth bit of the mode register 125, so that a signal DIR-RD assumed the 0 state. When the value of the signal DIR-RD goes to a "0", the data provided at the input terminal <0> of the multiplexer 142 (FIG. 3), that is, an output data WA7-0 of the word counter 143 is supplied as data RWA7-0 by the multiplexer 142, and is input to the dual port RAM 111. Next, the CPU 102 writes into the byte counter 144 the lower-order 2 bits of the address of the RAM 111*a* into which data should be written, and then writes the higher-order 8 bits of this address into the word counter 143. In consequence, this address is supplied to the address terminal AT1 of the dual port RAM 111. Subsequently, the CPU 102 writes a "0" into the pointer counter 119 (the previously-described first processing), and then outputs write data (the previously-described second processing). After such write data is temporarily held in the register 124 (FIG. 2), the data is written into the specified address of the RAM 111*a*** by the strobe signal $MW.

(iv) Operation of continuous writing of data into RAM 111

When data are to be continuously written into the dual port RAM 111, the CPU 102 first writes a "0" into each of zeroth, first and fifth bits of the mode register 125, so that each of the signals FIX-BA, AUT-INC, and DIR-RD assumes the "0" states. When the value of the signal FIX-BA goes to a "0", the output of the inverter 166 (FIG. 3) goes to a "1" signal, and the byte counter 144 assumes the enable state while the OR gate 145 serves as a mere buffer for feeding the carry output from the byte counter 144. In consequence, the counters 144 and 143 are arranged to function as a single 10-bit up counter. On the other hand, when the value of the signal DIR-RD goes to a "0", the data provided at the input terminal <0> of the multiplexer 142 (FIG. 3) is supplied by the multiplexer 142. Subsequently, the CPU 102 writes the lower-order 2 bits of a start address into the byte counter 144 and then its higher-order 8 bits into the word counter 143. For example, when the CPU 102 is to write data into the whole area (1024 bytes) of the RAM **111*a*, the CPU 102 writes data "0" into each of the counters 144 and 143. Next, the CPU 102 writes a "0" into the pointer counter 119 and then outputs the data which should be written into the address 0 of the RAM 111*a*. After this data output is temporarily held in the register 124 (FIG. 2), it is written into the address 0 of the RAM 111*a* in reponse to the strobe signal $MW. In addition, the strobe signal $MW is supplied to each of the up terminals UP of the registers 144 and 143 through the OR gate 167 (FIG. 3), thereby incrementing the content of the 10-bit counter constituted by the counters 144 and 143. Subsequently, the CPU 102 sequentially outputs the data which should be written into addresses "1" to "1023", in accordance with the second processing previously described. Accordingly, data is sequentially written into each of the addresses of the RAM 111*a***, and the content of the above-mentioned 10-bit counter is incremented in sequence.

I-3-2 Operation of CPU 102 when it reads data from RAM 111 or registers

The CPU 102 is capable of reading data out of the registers and the dual port RAM 111 at all times, independent of an image being displayed. During this reading, the read decoder 121 (FIG. 2) outputs any one of the strobe signals $MR to $RB. Data numbers are respectively allocated to all the data which can be read out. The relatioship between the data numbers, the strobe signals and the data to be read out is as follows:

| | |
|---|---|
| 0 | $MR . . . data within dual port RAM 111 |
| 1 | $ST . . . status data |
| 2 | $RR . . . data within border register 152r (FIG. 4) |
| 3 | $RG . . . data within border register 152g (FIG. 4) |
| 4 | $RB . . . data within border register 152b (FIG. 4) |

where the status data is the data representative of the status of each of the signals DTMG (on the lower side in FIG. 2), PG-SEL (at the left in FIG. 3) and BLANK3 (on the lower side in FIG. 4), these signals being applied to corresponding input terminals of the buffer 122 (FIG. 2).

The operation of the readout performed by the CPU 102 will be described below.

(i) Operation of separate reading of data

This operation concerns the operation by which any one of the data specified by the data numbers "1" to "4" is read out. In this operation, the CPU 102 first writes the data numbers into the pointer counter 119 in accordance with the previously described first processing. After the CPU 102 outputs the port address PA1 to the address bus of the bus line 106, it supplies a read pulse. (This processing is hereinafter referred to simply as "third processing"). When the port address PA1 is supplied to the interface 107, the interface 107 outputs the signal AO representative of "1". When the read pulse is supplied to the interface 107, the interface 107 outputs the signal WR representative of "0" and outputs the pulse signal CS at the same timing as the read pulse. When the signal AO goes to a "1" and the signal WR goes to a "0", the AND gate 169 shown in FIG. 2 is opened and thus outputs the pulse signal CS through the AND gate 169. This causes the buffer 127 to assumes an enable state. In addition, the pulse signal CS passing through the AND gate 169 is output as the read strobe RDST through the synchronizing DFF 118 and is applied to the read decoder 121. Thus the read decoder 121 outputs the strobe signal corresponding to a desired data number within the pointer counter 119. As an example, when the strobe signal $ST is output, the buffer 122 is caused to assume an enable state, so that the status data is output to the data bus DB7-0 of the CPU 102 through the buffers 122 and 127. As another example, when the strobe signal $RR is output, the buffer **153*r* shown in FIG. 4 assumes an enable state, so that the data (R color data) within the register 152*r* is output to the data bus DB7-0 of the CPU 102 through the buffers 153*r* and 127. The data supplied to the data bus DB7-0 of the CPU 102 is read by the CPU 102** at a predetermined timing.

(ii) Operation of continuous reading of data

This operation concerns the operation by which the CPU 102 continuously reads a plurality from the set of data specified by the data numbers "1" to 4. This operation is substantially the same as the previously described continuous writing of data into the registers. Therefore, detailed descriptions will be omitted for the sake of simplicity. In this case, the CPU 102 first writes a "1" into a first bit of the mode register 125, and then writes a first data number into the pointer counter 119. Subsequently the CPU 102 repeats the previously described third processing, so that each data is sequentially output to the data bus connected to the the CPU 102.

(iii) Operation of separate reading of data from RAM 111

When the CPU 102 is to read any one of the data within the dual port RAM 111, the CPU 102 writes a "0" into a fifth bit of the mode register 125, and then writes an address of the RAM **111*a* into the word counter 143 and the byte counter 144 (FIG. 3). The CPU 102 writes a data number "0" into the pointer counter 119, and carries out the previously described third processing. The read decoder 121 (FIG. 2) outputs the stobe signal $MR in accordance with the third processing, and supplies this output to a read terminal RT of the dual port RAM 111. In consequence, data is read out of the address specified by the output from the registers 143 and 144, and is output through the output teminal Q1 of the dual port RAM 111. The thus-obtained data is supplied to the data bus DB7-0 of the CPU 102 through the buffer 127**.

(iv) Operation of continuous reading of data from RAM 111

In the same manner as described above in "Operation of continuous writing of data into RAM 111", the CPU 102 first writes a "0" into each of the zeroth, first, and fifth bits of the mode register 125, and then writes the lower-order 2 bits of a start address into the byte counter 144 and the higher-order 8 bits of this address into the word counter 143. After the CPU 102 writes a data number "0" into the pointer counter 119, the previously described third processing is repeated. The stroge signal $MR is repeatedly output by repetition of this third processing, and the repeated strobe signals $MR sequentially increment the content of the 10-bit counter constituted by the counter 143 and 144. In consequence, the data within the dual port RAM 111 are sequentially read out in a unit of bytes, and are output to the data bus DB7-0 of the CPU 102 via the buffer 127.

(v) Operation of selective reading of data from RAM **111*a***

This operation concerns the operation by which solely any one of the R color data, the G color data, the B color data and the attribute bit data A is continuously read from the RAM **111*a* shown in FIG. 5. In this operation, the CPU 102 first writes a "1", a "0" and a "0" into the zeroth, first and fifth bits of the mode register 125, respectively. In response to these bit signals, the values of the signals FIX-BA, AUT-INC and DIR-RD goes to a "1", a "0" and a "0" , respectively. When the signal FIX-BA goes to a "1", an inverter 166 (FIG. 3) outputs a "0" signal, and this "0" signal is supplied to the enable terminal EN of the byte counter 144. In consequence, if a pulse signal is supplied to the up terminal UP of the byte counter 144, the byte counter 144 does not count upward, and therefore the output of the byte counter 144** is maintained at a constant value.

When the signal FIX-BA goes to a "1" signal, the output of the OR gate 145 (FIG. 3) goes to a "1" signal, and this "1" signal is supplied to the enable terminal EN of the word counter 143. Consequently, the word counter 143 independently operates as an 8-bit counter for counting up the pulse signals supplied to the up terminal UP. When the signal AUT-INC goes to a "0", the AND gate 163 (FIG. 2) is closed; whereas, when the singal DIR-RD goes to a "0", the output of the word counter 143 is supplied by the multiplexer 142 (FIG. 3).

Next, the CPU 102 writes into the byte counter 144 numbers corresponding to the kinds of data which are to be read. Specifically, the CPU 102 writes a "0" when it is to read the R color data, a "1" when it is to read the G color data, a "2" when it is to the read B color data, and a "3" when it is to read the attribute bit data A (refer to FIG. 5). Then, the CPU 102 writes a start address into the word counter 143 and then a "0" into the pointer counter 119. Subsequently, the previously described third processing is repeated. The content of the word counter 143 is sequentially incremented in response to the strobe signals $MR by repetition of the third processing, so that data of the only kind which is determined by the output of the byte counter 144 (or address data BA1-0) are sequentially read out of the RAM 111*a*.

(vi) Operation of reading of data from RAM 111 on the basis of external address data When a "1" is written into a fifth bit of the mode register 125, the DIR-RD goes to a "1" signal, and thus the data provided at the input terminal <I> of the multiplexer 142 is output from this multiplexer. Therefore, when address data is supplied to the terminal T7 (FIGS. 1, 3) of the display controller 101, the address data is delivered to the dual port RAM 111 via the synchronizing register 141 and the multiplexer 142. In consequence, the reading of data can be performed on the basis of the external address data.

I-3-3 Basic operation of display controller 101

The most basic operation of the display controller 101 is such that the dot data DD7-0 output from the VDP 104 (FIG. 1) is converted into the R, G and B color data, and the obtained R, G and B color data are further converted into the analog color signals RS, GS and BS, thereby supplying these signals to the CRT display unit 108. The operation in this case will be described below.

The CPU 102 first writes a "1" in a second bit of the mode register 125, so that the signal DISP-ENB goes to a "1" signal and an AND gate 171 (FIG. 2) is enabled to open. The CPU 102 then writes 4-bit data "0" into the page mask register 134 (FIG. 3). In consequence, a "0" signal is supplied to the control terminal C of each of the multiplexers 136 to 139, and thus the output of the synchronizing register 133 is supplied through the multiplexers 136 to 139. Specifically, the dot data DD7-0 is applied as the dot data DDa7-0 to the address terminal AT2 of the dual port RAM 111 through the synchronizing registers 133 and 135. Next, the R, G and B color data are written, and data "0 . . . 0" (in 8-bit form) is written into the dual port RAM 111 in the form of the attribute bit data A for each color data. Color data for specifying the color of the border region is written into each of the the border registers 150*r*, 150*g* and 150*b* (FIG. 4). Next, the CPU 102 writes dot data (or color codes) into the VRAM 105 through the VDP 104, and then outputs a start command to the VDP 104. When the VDP 104 receives the start command, it reads the dot data out of the VRAM 105 and sequentially supplies the read dot data as the dot data DD7-0 to the terminal T2 of the display controller 101. In parallel with the dot data output DD7-0, the VDP 104 outputs the synchronizing signal SYN·I, the blanking signal BLANK, the display timing signal DTMG, and the dot clock DCLK to the terminals T3, T4, T5 and T17 of the display controller 101, respectively.

The dot data DD7-0 supplied to the terminal T2 of the display controller 101 is applied as the dot data DDa7-0 to the addresss terminal AT2 of the dual port RAM 111 via the registers 133, 135 (FIG. 3) and the respective multiplexers 136 to 139 (higher-order 4 bits). In consequence, the R, G and B color data RD7-0, GD7-0, BD7-0 and the attribute data AD7, AD6 (in this case, both are "0"s) are respectively output through the output terminals Q2, Q3, Q4 and Q5 of the dual port RAM 111 in correspondence with the dot data DDa7-0. The color data RD7-0 is applied to one input of the adder circuit 149*r* through the register 147*r* for providing a delay of one dot clock time. At this time, since the attribute signal AS "0" is applied to the control terminal C of the multiplexer 148*r*, the multiplexer 148*r* outputs the data "0" provided at its input terminal <0>. In consequence, the output from the adder circuit 149*r* is the same color data as that of the register 147*r*, and the thus-obtained color data is supplied to the input terminal <I> of multiplexer 151*r*.

During the image displaying period, the multiplexer 151*r* outputs the color data which is representative of an image to be displayed and which is supplied from the adder circuit 149*r*, while, during other periods, it outputs color data held in the border register 150*r* for the purpose of specifying border color. Specifically, the display timing signal DTMG (a signal indicative of the screen displaying period) supplied from the VDP 104 is synchronized with the dot clock DCLK by the DFF 172 (at the bottom in FIG. 2), being further delayed by one dot clock time by the DFF 173 and being supplied to the control terminal C of the multiplexer 151*r* through the AND gate 171. Therefore, during the image displaying period, the multiplexer 151*r* outputs the color data supplied from the adder circuit 149*r* to the register 152*r*. During the other periods, the multiplexer 151*r* outputs the color data within the register 150*r* to the register 152*r*. The register 152*r* delays the color data supplied from the multiplexer 151*r* by one-dot-clock time, supplying the delayed signal to the gate circuit 154*r*. The gate circuit 154*r* is the circuit which is opened and closed under control of the signal BLANK3. The signal BLANK3 is derived from the blanking signal BLANK supplied from the VDP 104 (a signal being a "1" during the screen displaying period). Specifically, the signal BLANK3 is obtained by synchronizing the blanking signal BLANK with the dot clock DCLK by the synchronizing register 175 and delaying it by two-dot-clock time by means of the delay registers 146 and 176. Therefore, during the screen displaying period, the gate circuit 154*r* is opened to output the color data within the register 152*r* to the DAC 155*r*. In this fashion, the dot data DD7-0 is subjected to synchronization by the registers 133 and 135 shown in FIG. 3, and, after it is delayed by two-dot clock time by means of the registers 147*r* and 152*r* shown in FIG. 4, the delayed data is applied to the gate circuit 154*r*. Therefore, the timing at which the dot data DD7-0 converted into color data is applied to the gate circuit 154r is the same as the timing at which the blanking signal BLANK is output as the signal BLANK3. The color data passing through the gate circuit 154r is converted into an analog color video signal by the DAC 155r, and is output as the color video signal RS to the CRT display unit 108 by the amplifier 156r.

The above description has been made with respect to the process by which the color data RD7-0 is converted into the color video signal RS. It will be understood that the color data GD7-0 and BD7-0 are respectively converted into the color video signals GS and BD in the same manner.

On the other hand, the synchronizing signal SYN·I output from the VDP 104 is subjected to synchronization by the register 175 (at the bottom in FIG. 4) and is delayed by two-dot clock time by means of the registers 146 and 176, so that it is output to the CRT display unit 108 in the form of a synchronizing signal SYN.O by the amplifier 178. In consequence, an image is displayed on the CRT display unit 108 on the basis of the above-mentioned color video signals RS, GS, BS and the synchronizing signal SYN O.

I-3-4 Operation of displaying blinking image

This operation concerns the operation by which a displayed image is made to blink on the basis of the above-described basic displaying operation. In this operation, the CPU 102 writes first and second data (4 bits for each) into the page registers 130 and 131 (FIG. 3), respectively, and then writes the data "1111" into the page mask register 134. When a "1" is written into a fourth bit of the mode register 125, the signal PG-ENB goes to a "1" signal and this "1" signal is supplied to a first input terminal of the AND gate 175 (at the left in FIG. 3). A second input terminal of the AND gate 175 receives the signal PG-SEL supplied from the VDP 104 (a signal repeating the "1" and 0 states every 0.5 seconds) by the synchronizing DFF 176. Therefore, when the signal PG-ENB goes to a "1" signal, the AND gate 175 supplies a singal repeating the "1" and 0 states every 0.5 seconds to the control terminal C of the multiplexer 132. In consequence, the multiplexer 132 alternately outputs the first data of the page register 130 and the second data of the page register 131 every 0.5 seconds. These output data are applied to the input terminal <I> of each of the multiplexers 136 to 139. Next, when data "1111" is written into the page mask register 134, a "1" signal is supplied to the control terminal C of each of the multiplexers 136 to 139. Therefore, the first and second data are alternately output from the page registers 130 and 131, respectively. The thus-obtained data are subtituted for the higher-order 4 bits of the dot data DD7-0 and are combined with the lower-order 4 bits of the dot data DD7-0, thus being supplied to the address terminal AT2 of the dual port RAM 111 in the form of the dot data DDa7-0. Specifically, the contents of the dot data DDa7-0 are changed every 0.5 seconds, thereby causing the displayed image to blink.

It should be noted that, as an example, when data "1100" is written into the page mask register 134, only the higher-order 2 bits of the dot data DDa7-0 can be replaced with the data within the page registers 130 and 131. As another example, when data "1000" is written into the page mask register 134, only the highest-order bit of the dot data DDa7-0 can be replaced with another data.

I-3-5 Operation of modifying color data

The display controller 101 is capable of varying the color data RD7-0, GD7-0 and BD7-0 without rewriting the content of the VRAM 104, by writing a "1" into a seventh bit of the attribut bit data A of the dual port RAM 111. This operation will be described below.

As an exmaple, it is assumed that a "1" is written into the seventh bit of the attribute bit data A corresponding to a certain color code K1. In this case, when the color code K1 is applied as the dot data DDa7-0 to the address terminal AT2 of the dual port RAM 111, the RAM 111 outputs the color data RD7-0, GD7-0 and BD7-0 correponding to the color code K1 and at the same time a "1" signal as the attribute data AD7. These color data enter the registers 147r, 147g and 147b (only the register 147r is shown in FIG. 4) and at the same time the attibute data AD7 "1" enters the register 146, thereby causing the attribute signal AS to goes to a "1" signal. When the attribute signal AS in the "1" state is applied to the control terminal C of the multiplexer 148r, the color data within the register 152r is supplied to the adder circuit 149r through the mulitplexer 148r, so that the adder circuit 149r outputs new color data obtained by adding the color data within the register 147r to that within the register 152r. The color data within the register 152r relates to determination of the color of the dot which is displayed one-dot-clock time before the following color data enters the register 147r. Therefore, the addition of the color data within the register 147r and that within the register 152r means the addition of the color data within the register 147r and the color data on the dot which is displayed one-dot-clock time before.

The above description concerns the operation of modifying the color data RD7-0, and it will be appreciated that, when the attribute signal AS is a "1", the same modification can be applied to the color data GD7-0 and BD7-0.

The effect of this color data modification will be described below. It is assumed here that the color code "0" corresponds to the color data stored at the addresses 0 to 2 shown in FIG. 5.

Figure 6:
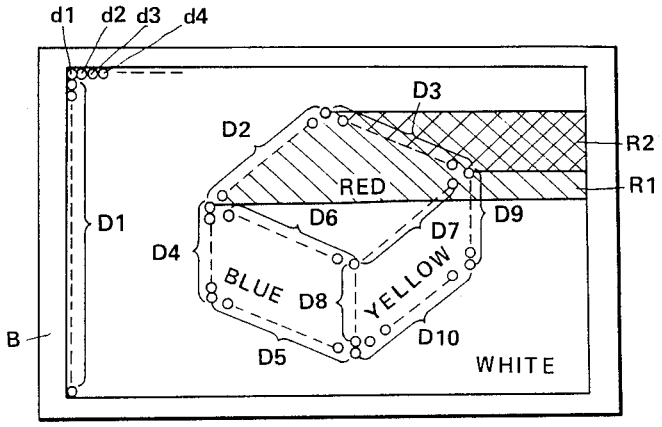
FIG. 6 schematically shows an example of the image displayed on the CRT display unit 108 shown in FIG. 1.

(i) As an example, an explanation will be given below of a box having red, blue and green surfaces displayed against a white background color. In FIG. 6, a region B represents the border region. In this case, the color code "0" is first written into the whole region of the VRAM 105 (the VRAM 105 is cleared), and then the color code for specifying white is written into the memory location of the VRAM 105 corresponding to each dot contained in a leftmost dot column D1 within the image displaying region. Secondly, a "1" is written into a seventh bit of the attribute bit data A corresponding to the color code "0" within the dual port RAM 111. In consequence, the entire image displaying region is displayed in white. The reason for this is as follows. First, when the color code corresponding to the dot d1 shown in FIG. 6 is read out of the VRAM 105, the dot d1 is displayed in white. Secondly, when a "0" is read out as the color code corresponding to the following dot d2 and is supplied to the dual port RAM 111, the RAM 111 outputs "0"s as the dot data RD7-0, GD7-0 and BD7-0 and at the same time a "1" as the attribute data AD7. In each of the adder circuits 149r, 149g and 149b, the color code of the preceding dot d1 is added to the "0", and the result of this addition, namely, the color data representative of white is output by the respective adder circuits 149*r*, 149*g* and 149*b*. In accordance with the thus-obtained color data, the dot d2 is displayed in white. In the same manner, the entire image displaying region is displayed in white.

Next, the color code representative of red is written into the memory location of the VRAM 105 corresponding to each dot contained in a dot line D2, thereby displaying a region R1 in red. Subsequently, the color code representative of white is written into the memory location of the VRAM 105 corresponding to each dot contained in a dot line D3, thereby displaying a white region R2 within the region R1. Similarly, if color codes representative of blue, blue, red, yellow, yellow, white and white are stored in the VRAM 105 in correspondence with dot lines D4 to D10, the visual display shown in FIG. 6 can be completed. As is well known, with the conventional apparatus, it has been necessary to write color codes into the entire region of the VRAM 105. However, in accordance with the first preferred embodiment, it is sufficient merely to write color codes into the memory location within the VRAM 105 in correspondece with the boundaries between images to be displayed.

Figure 7:
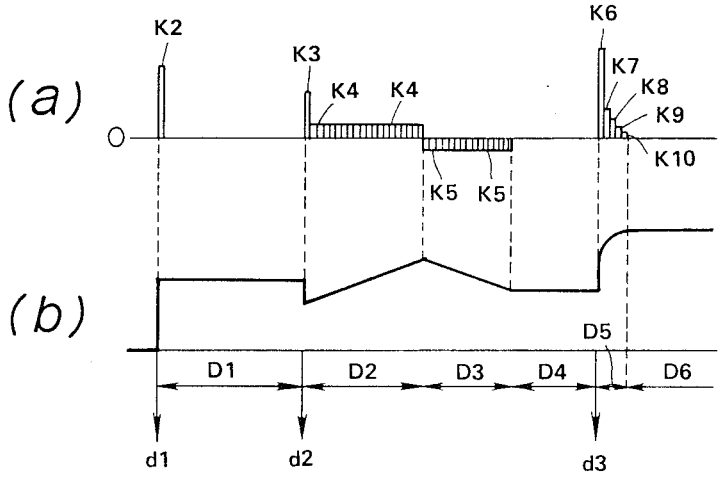
FIG. 7 is a chart showing the color codes read from the VRAM 105 of FIG. 5 and the wave form of the color signal generated on the basis of these color codes.

(ii) It is assumed here that, color codes K2, K3, . . . as shown in part (A) of FIG. 7 are written into the VRAM 105 in correspondence with each dot contained in a certain horizontal line on the screen and that a "1" is written into a seventh bit of the attribute bit data A within the dual port RAM 111 corresponding to each of the color codes "0", K4, K5, K7, K8, K9 and K10. In addition, it is assumed for the sake of simplicity that each of the color codes K2 to K10 is a color code specifying red. (The G color data and the B color data are "0"s). FIG. 7 also shows the value of the R color data corresponding to each of the color codes K2 to K10. A negative color data (the color code K5) is stored in the form of a 2*s* complement.

In the above-described manner in which each color code is stored, this horizontal line is displayed as shown in part B of FIG. 7. More specifically, the leftmost dot d1 is diplayed in red corresponding to the color code K2. The following dot range D1 is also displayed in red corresponding to the color code K2. The dot d2 adjacent to the dot range D1 is displayed in red corresponding to the color code K3. The dot range D2 extending from the dot d2 is displayed in red such that luminance is gradually increased in a unit of one dot. The dot range D3 following the dot range D2 is displayed in red such that the luminance is gradually decreased. The dot range D4 following the dot range D3 is displayed in red having the same luminance as that of the last dot in the range D3. The ensuing dot d3 is displayed in red corresponding to the color code K6. The dot range D5 following the dot d3 is displayed in red such that luminance is increased curvilinearly. The following dot range D6 is displayed in red having the same luminance as that of the last dot of the dot range D5.

In accordance with the above-described displaying method, the use of attribute bits is advantageous in the following respects. If no attribute bits are used, the number of the colors which can be displayed on the 8-bit color codes is only two hundred fifty-six (where the content of the dual port RAM 111 is not rewritten). However, in the dot ranges D2, D3 and D5, the above-described displaying method using attribute bits enables various other colors to be displayed in addition to the 256 colors. Therefore, as an example, when the color data corresponding to the color code K4 has an extremely small value, it is possible to finely change tone in the dot range D2. This advantage is remarkably useful when a solid figure is to be displayed.

The above description concerns the details of the first preferred embodiment of the present invention. It should be noted that, while the first embodiment is arranged such that the attribute bit data A is stored in the LUT, the data A could be stored in the VRAM 105 instead of the LUT. In this arrangement, the R, G and B color data and the attribute bit data A could be stored in the VRAM 105 in correspondence with each dot, and such data may be read out of the VRAM 105, thus being supplied to the respective data modifier circuits 112*r*, 112*g* and 112*b* and register 146 shown in FIG. 4.

II Second embodiment

The second preferred embodiment of the present invention described below is arranged such that color data and attribute data, as described above, are stored in a VRAM, and more complicated operations are provided on the color data on the basis of the attribute data, thereby enabling a colorful image to be displayed.

II-1 Diagrammatic construction of second embodiment

Figure 8:
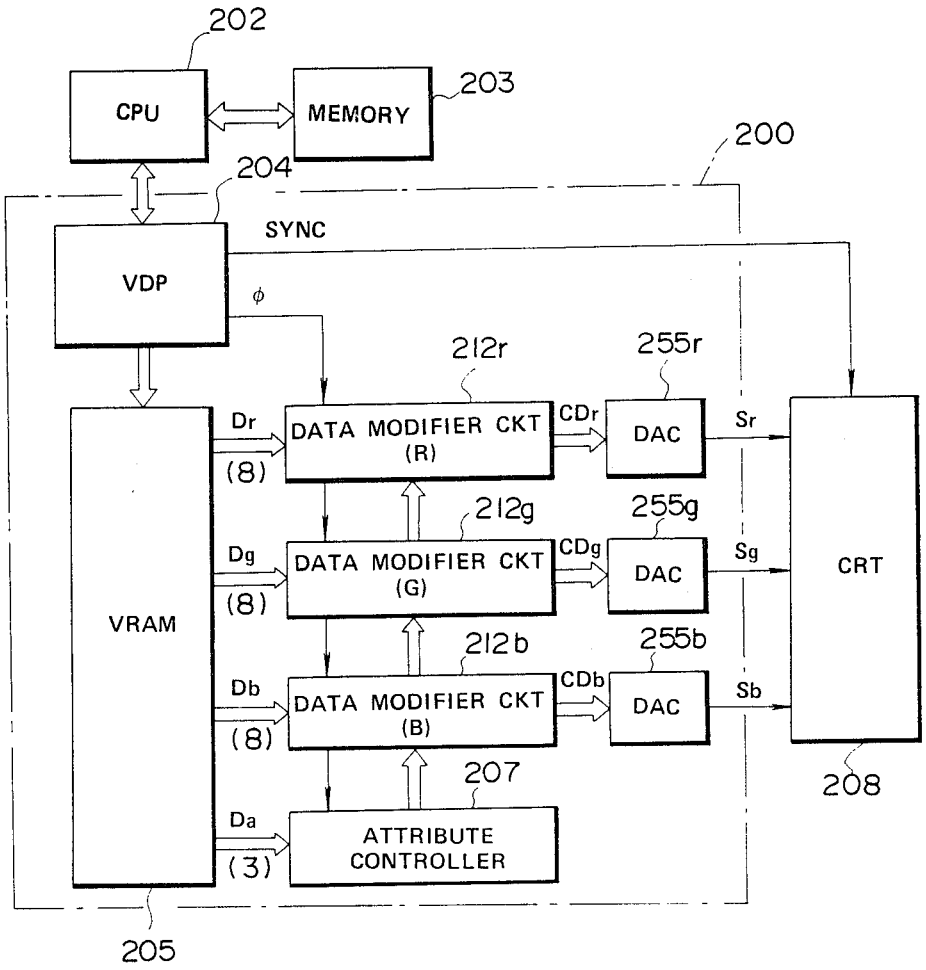
FIG. 8 is a block diagram of a display system which incorporates an image display apparatus 200 constituting a second preferred embodiment of the present invention.

FIG. 8 is a block diagram of a color display system which incorporates the image display apparatus 200 constituting the second preferred embodiment of the present invention.

Figure 9:
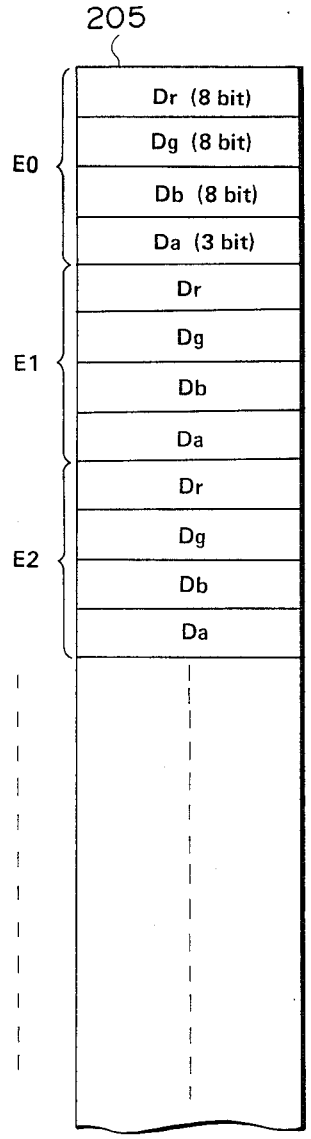
FIG. 9 schematically shows the arrangement of the data stored within a RAM 205 forming part of the display apparatus 200 shown in FIG. 8.

As shown in FIG. 8, the color display system essentially comprises: a CPU 202; a memory 203 including a ROM (read only memory) for storing program and a RAM (random access memory) for storing data, such program and data being used in the CPU 202; a VDP 204; and a VRAM 205. The VRAM 205, as shown in FIG. 9, has storage areas E0, E1, . . . (27 bits for each area) in correspondence with the respective dots on the screen of the CRT display unit 208. The storage areas E0, E1 . . . respectively contain display data for each dot to be displayed, namely, R data Dr, G data Dg, B data Db (8 bits for each data) and attribute data Da (3 bits).

The VDP 204 writes the display data supplied from the CPU 202 into the VRAM 205. The VDP 204 also includes a clock generating circuit for generating a dot clock $\phi$ and, when the CPU 202 outputs a display command, the VDP 204 repeatedly reads the display data out of the respective storage areas E0, E1 . . . of the VRAM 205 in sequence at the timing provided by the dot clock $\phi$. The thus-read data Dr, Dg, Db and Da are respectively supplied to data modifier circuits 212*r*, 212*g*, 212*b* and an attribute controller 207. The VDP 204 also supplies the dot clock $\phi$ to the data modifier circuits 212*r*, 212*g*, 212*b* and the attribute controller 207, and further outputs a synchronizing signal SYNC to the CRT display unit 208.

Figure 10:
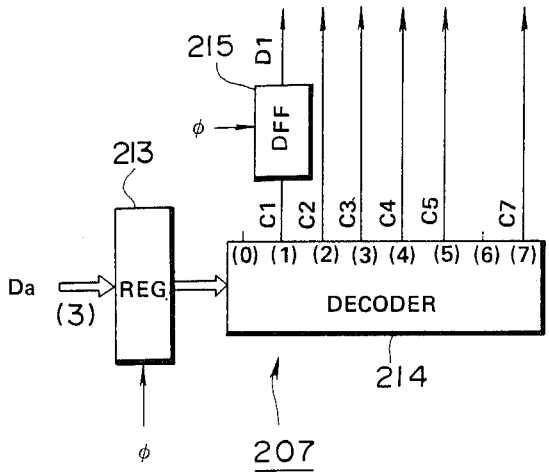
FIG. 10 is a logic diagram of an attribute controller 207 forming part of the image display apparatus 200 shown in FIG. 8.

The data modifier circuits 212*r*, 212*g* and 212*b* respectively generate color data CDr, CDg and CDb on the basis of the data Dr, Dg and Db supplied from the VRAM 205, and output them to correponding DACs (digital/analog converters) 255*r*, 255*g* and 255*b*. The details of this circuitry will be described later. The DACs 255*r*, 255*g* and 255*b* respectively convert the color data CDr, CDg and CDb into analog signals such as a red color signal Sr, a green color signal Sg, and a blue color signal Sb, thus ouputting them to the CRT display unit 208. As shown in FIG. 10, the attribute controller 207 includes: a register 213 for reading attribute data Da at the timing provided by the dot clock $\phi$; a decoder 214 for decoding the output from the register 213; and a DFF (delay flip-flop) 215 for delaying the signal C1 supplied from the output terminal <1> of the decoder 214 by one-dot-clock time, namely, one cycle of the dot clock $\phi$. The output signal D1 of the DFF 215, the signals C2, C3, C4, C5 and C7 output from the output teminals <2><3><4><5> and <7> of the decoder 214 are supplied in parallel with one another to each of the the data modifier circuits 212*r*, 212*g* and 212*b*.

II-2 Details of Data Modifier Circuits 212*r*, 212*g* and 212*b*

The data modifier circuits 212*r*, 212*g* and 212*b* have the same constructions as one another, so the details of the data modifier circuit 212*r* will be described with reference to FIG. 11, but the descriptions of the other circuits 212*g* and 212*b* will be omitted for the sake of simplicity.

Figure 11:
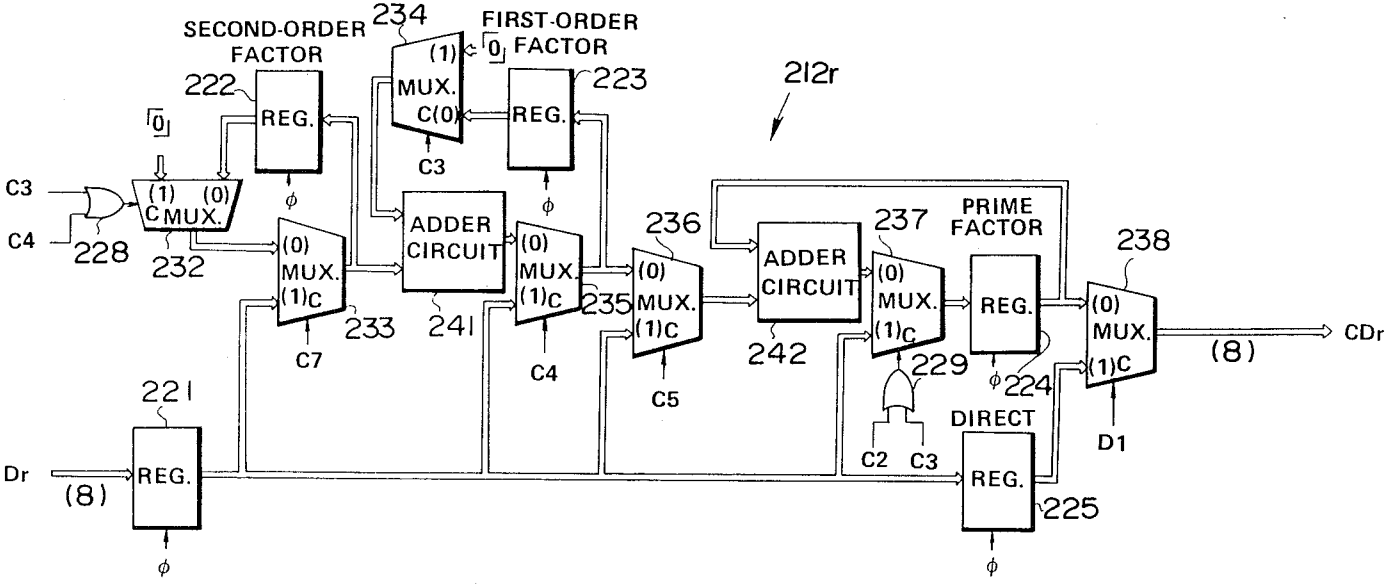
FIG. 11 is a logic diagram of a data modifier circuit 212*r* forming part of the image display apparatus 200 shown in FIG. 8.

As shown in FIG. 11, the data modifier circuit 212*r* includes 8-bit registers 221 to 225, OR gates 228 and 229, multiplexers 232 to 238 and the adder circuits 241 and 242. The registers 221 to 225 are respectively 8-bit registers arranged to read data at the timing provided by the dot clock $\phi$. Each of the multiplexers 232 to 238 outputs the data provided at its input terminal <I> when a "1" signal is supplied to its control terminal C, but, when a "0" signal is supplied to the terminal C, it outputs the data provided at its input terminal <0>.

The operation of the data modifier circuit 212*r* will be described below. The operation of the circuit 212*r* depends on whether the signals D1, C2, C3, C4, C5 and C7 respectively assume the "1" or "0" state, that is, it is determined in accordance with the value ("0" to "7") of the attribute data Da. The operations corresponding to the attribute data Da are as follows.

0: Non Modulation
1: Direct Display
2: Load Prime
3: Load Prime with Reset
4: Load First
5: Load Step
6: Non Modulation
7: Load Second The above listed operations will be described in detail below.

(i) Direct Display (da="1")

When the VRAM 205 outputs the attribute data Da "1", the direct register 225 (FIG. 11) reads the R data Dr which is supplied from the VRAM 205 simultanously with the attribute data Da "1", and the R data Dr thus read is supplied as the color data CDr via the multiplexer 238. Specifically, the attribute data Da "1" output from the VRAM 205 is first read by the register 213 (FIG. 10), and is supplied to the decoder 214, so that the signal C1 at the input terminal <1> of the decoder 214 goes to a "1" signal. This "1" signal C1 is delayed by one cycle of the dot clock $\phi$ by means of the DFF 215, and the thus-delayed signal is supplied to the multiplexer 238 shown in FIG. 11. In this fashion, two cycles of the dot clock $\phi$ after the time when the VRAM 205 outputs the attribute bit data Da "1", a "1" signal is supplied as the signal D1 to the multiplexer 238. On the other hand, the R data Dr output from the VRAM 205 is read by the register 221 shown in FIG. 11 at the timing provided by the dot clock $\phi$, and, after it is supplied to the register 225, the data is delivered to the input terminal <I> of the multiplexer 238. Specifically, two cycles of the dot clock $\phi$ after the time when the VRAM 205 outputs the R data Dr, the same R data Dr is supplied to the input terminal <I> of the multiplexer 238. At this time, since the signal D1 is a "1" signal is described previously, the R data Dr is supplied as the color data CDr to the DAC 225*r* through the multiplexer 238.

(ii) Load Prime (Da="2")

When the VRAM 205 outputs the attribute data Da "2", the prime factor register 224 reads the R data Dr which is supplied from the VRAM 205 simultanously with the attribute data Da "2". Specifically, one cycle of the dot clock $\phi$ after the time when the VRAM 205 outputs attribute data Da "2", the signal C2 goes to a "1" signal. This "1" signal is supplied to the multiplexer 237 via the OR gate 229 (FIG. 11). On the other hand, the R data Dr which is output by the VRAM 205 is read out of the register 221 after one cycle of the dot clock $\phi$, and is supplied to the input terminal <I> of the prime factor register 224 via the multiplexer 237. The thus-supplied R data Dr is read by the prime factor register 224 at the timing provided by the following dot clock $\phi$. The R data Dr thus read is output as the color data CDr through the multiplexer 238.

(iii) Load Prime with Reset (Da="3")

When the VRAM 205 outputs attribute data Da "3", the prime factor register 224 reads the R data Dr which is supplied from the VRAM 205 simultanously with the attribute data Da "3". Meanwhile, the first-order factor register 223 and the second-order factor register 222 are reset. Specifically, when the VRAM 205 outputs the attribute data Da "3", the signal C3 goes to a "1" signal. This "1" signal C3 is supplied to the multiplexer 237 through the OR gate 229 and to the multiplexer 234, and further to the multiplexer 232 through the OR gate 228. In consequence, in the same manner as described aboved, the R data Dr is read by the prime factor register 224 and at the same time the data "0" provided at the input terminal <I> of the multiplexer 232 is supplied to the input terminal of the second-order factor register 222 through the multiplexers 232 and 233, thus being read by the same register 222 at the timing provided by the following dot clock $\phi$. The data "0" provided at the input terminal <I> of the multiplexer 234 is supplied to one input terminal of the adder circuit 241 and is added to the data "0" which is supplied from the multiplexer 233 at this time. The result of this addition "0" is supplied to the input terminal of the first-order factor register 223 through the multiplexer 235, thus being read by the same register 223 at the timing provided by the dot clock $\phi$.

(iv) Load First (Da="4")

When the VRAM 205 outputs attribute data Da "4", the first-order factor register 223 reads the R data Dr which is supplied from the VRAM 205 simultanously with the attribute data Da "4", while the second-order factor register 222 is reset.

More specifically, when the attribute data Da "4" is output, the signal C4 goes to a "1" signal. The thus-obtained "1" signal is supplied to the multiplexer 235 and through the OR gate 228 to the multiplexer 232. In consequence, the R data Dr which is read by the register 221 is supplied to the input terminal of the first-order factor register 223 through the multiplexer 235, then being read by the same register 223 at the timing provided by the following dot clock $\phi$. Also, the data "0" provided at the input terminal <I> of the multiplexer 232 is supplied to the input terminal of the second-order factor register 222 through the multiplexers 232 and 233, thus being read by the same register 222 at the timing provided by the following dot clock $\phi$.

(v) Load Step (Da="5")

When the VRAM 205 outputs attribute data Da "5", the R data Dr which is simultanously supplied from the VRAM 205 is added to the content of the prime factor register 224. The result of this addition is written into the register 224.

More specifically, when the attribute data Da "5" is output, the signal C5 goes to a "1" signal. The thus-obtained "1" signal is supplied to the multiplexer 236. In consequence,-the R data Dr which is read by the register 221 is supplied to the adder circuit 242 through the multiplexer 236. When the R data Dr is added to the content of the prime factor register 224 in the adder circuit 242, the result of this addition is supplied to the input terminal of the prime factor register 224 through the multiplexer 237, thus being read by the register 224 at the timing provided by the following dot clock $\phi$.

(vi) Load Second (Da="7")

When the VRAM 205 outputs attribute data Da "7", the second-order factor register 222 reads the R data Dr which is simultanously supplied from the VRAM 205.

More specifically, when the attribute data Da "7" is output, the signal C7 goes to a "1" signal. The thus-obtained "1" signal is supplied to the multiplexer 233. In consequence, the R data Dr which is read by the multiplexer 221 is supplied to the input terminal of the second-order factor register 222 through the multiplexer 233, then being read by the register 222 at the timing provided by the following dot clock $\phi$.

(vii) Non Modulation (Da="0" or "6")

When the VRAM 205 outputs attribute data Da "0" or "6", all the signals D1, C2 to C5 and C7 assume the 0 state. In this case, the circuit shown in FIG. 11 operates as follows.

The output of the second-order factor register 222 is supplied to the input terminal of the same register 222 through the multiplexers 232 and 233, then being read by the register 222 at the timing provided by the dot clock $\phi$. Specifically, the data within the register 222 is held in a circular manner, and also the same data is supplied to the adder circuit 241. The data within the first-order factor register 223 is supplied through the multiplexer 234 to the adder circuit 241 in which the supplied data is added to the data of the second-order factor register 222. The result of this addition is supplied to the adder circuit 242 through the multiplexers 235 and 236, and at the same time is supplied to the input terminal of the register 223 through the multiplexer 235, thus being read by the register 223 at the timing provided by the following dot clock $\phi$. Therefore, when the VRAM 205 continuously outputs the attribute data Da "0", the data within the register 222 is repeatedly added to that within the register 223 at the timing provided by the dot clock $\phi$. In the meantime, the data within the prime factor register 224 is supplied to the adder circuit 242 in which this data is added to the output of the multiplexer 236, namely, the output of the adder circuit 241. The result of this addition is supplied to the input terminal of the register 224 through the multiplexer 237, thus being read by the register 224 at the timing provided by the following dot clock $\phi$. The thus-obtained data within the register 224 is output as the color data CDr through the multiplexer 238. Therefore, when the VRAM 205 continuously outputs the attribute data Da "0", the output of the adder circuit 241 is sequentially added to the data within the register 224 at the timing provided by the dot clock $\phi$. The result of this addition is sequentially supplied as the color data CDr. In this fashion, when the attribute data Da represents "0" or "6", the color data CDr is the data which is independent of the R data Dr output by the VRAM 205

The above description has been made with respect to the operation of the data modifier circuit **212*r* corresponding to the attribute data Da. Incidentally, the operation of each of the data modifier circuits 212*g* and 212*b* is completely the same as that of the circuit 212*r***, so the descriptions will be omitted II-3 Overall operation of second embodiment The entire operation of the display system incorporating the second embodiment will be described in accordance with the respective states of the image being displayed on the screen.

(i) Constant Shading

This constant shading is the operation by which a portion of the screen is displayed in one color.

Figure 12:
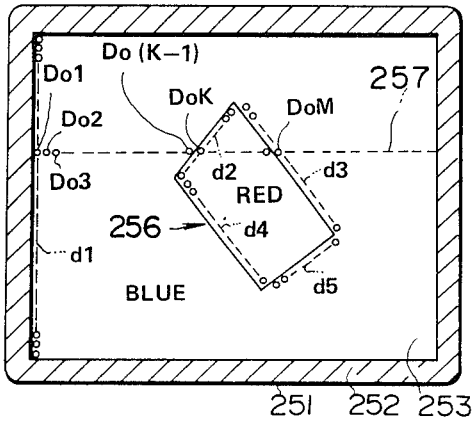
FIG. 12 schematically shows an example of the image displayed on the CRT display unit 208 shown in FIG. 8.

Referring to FIG. 12, a display screen 251 of the CRT display unit 208 includes a border region 252 (a region where no image is displayed) and an image display region 253 (a region where an image is displayed). The following discussion relates to an illustrative case where an red image 256 is displayed against a blue background color in the image display region 253.

In this operation, the CPU 202 first clears the VRAM 205, and writes the B data Db "11 . . . 1" in 8-bit form and the attribute bit data Da "3" (011) into the storage area E (FIG. 9) corresponding to each of the dots in the leftmost dot column d1 in the image display region 253. Secondly, the CPU 202 writes the R data Dr "11 . . . 1" and the attribute data Da "3" into the storage area E corresponding to each of the dots in the dot lines d2, d4 on the left side of the image 256. Thirdly, the CPU 202 writes the B data Db "11 . . . 1" and the attribute data Da "3" into the storage area E corresponding to each of the dots in the dot lines d3, d5 on the right side of the image 256. Finally, the CUP 202 outputs a display command. In response to the display command, display data is read out of the VRAM 205 at the timing provided by the dot clock $\phi$ and in a sequence starting from the display data Dr, Dg, Db and Da corresponding to the leftmost dot in the uppermost line of the image display region 253, thereby displaying the colored dots on the basis of the thus-read data. Such a display operation will be described below with illustrative reference to the dot line 257 shown in FIG. 12.

The VRAM 205 first outputs the display data corresponding to a leftmost dot Dol on the dot line 257. When two cycles of the dot clock $\phi$ pass after this data output, the registers 222 and 223 within each of the data modifier circuits **212*r*, 212*g* and 212*b* are reset and the data Dr, Dg and Db are read by the prime factor register 224 of each of the data modifier circuits 212*r*, 212*g* and 212*b*. The thus-read data Dr, Dg and Db are supplied through the multiplexer 238 to the DACs 255*r*, 255*g* and 255*b*, respectively, in which they are converted into color video signals Sr, Sg and Sb, then being output to the CRT display unit 208. In consequence, the leftmost dot Dol on the dot line 257 is displayed in blue. Secondly, the VRAM 205 outputs the display data corresponding to a second leftmost dot Do2 on the dot line 257. The attribute bit data Da for this display data is a "0". (The respective data Dr, Dg and Db are naturally "0"s.) Therefore, two-dot clock time after the time when the VRAM 205 outputs such display data, the register 224 reads the sum of the data within the register 224 and the output of the multiplexer 236, and the thus-read data is supplied through the multiplexer 238 in the form of the color data CDr, CDg and CDb. In this state, the data within each of the registers 222 and 223 is a "0" and thus the multiplexer 236 has a "0" output, so that the above-described reading does not alter the data within the register 224. Specifically, the second leftmost dot Do2 is displayed in the same blue as that of the first dot Do1. Similarly, the following dots, i.e., a third dot Do3, a fourth dot Do4 and so forth are displayed in blue Subsequently, when the display data corresponding to a dot DoK shown is read out of the VRAM 205, the dot DoK is displayed in red in the same manner as the Do1, and the registers 222 and 223 are again cleared. Similarly, a dot Do(K+1), a dot Do(k+2), . . . are displayed in red in sequence. Next, the display data corresponding to a dot DoM is read out of the VRAM 205, so that the dot DoM is displayed in blue. Subsequently, the remaining dots along the dot line 257 are displayed in blue. The above description has been made with respect to the process of the dot line 257** being displayed in color, and the other dot lines are also displayed in color in completely the same manner.

As will be evident from the foregoing, when the constant shading is to be performed, it is sufficient to write data representative of the sole contours of an image into the VRAM 205.

(ii) Gouraud Shading (linear interpolation shading)

The Gouraud Shading is the operation by which a color to be displayed is gradually varied at a constant rate. The following discussion concerns the case of displaying an image 258 shown in FIG. 13. In particular, an explanation will be made of the case where the dot DoK shown is displayed on the basis of color data Cr-a, Cg-a and Cb-a, the dot DoL shown being displayed on the basis of color data Cr-b, Cg-b and Cb-b, and the dots between the dots DoK and DoL being linearly varied as shown in FIG. 14. The following description illustratively refers to the color data CDr indicative of red (R). In this case, the VRAM 205 is arranged to store the following display data:

the display data corresponding to the dot DoK

Dr=Cr−a,

Da=3;

the display data corresponding to the dot Do(K+1)

$$Dr = \frac{(Cr - b) - (Cr - a)}{n} = \Delta$$

(where n is the number of the dots between the dots DoK and DoL and negative numbers are represented by complements of those numbers)

Da=4; and the display data corresponding to the dot Do(K+2) to DoL

Dr=0,

Da=0.

Figure 15:
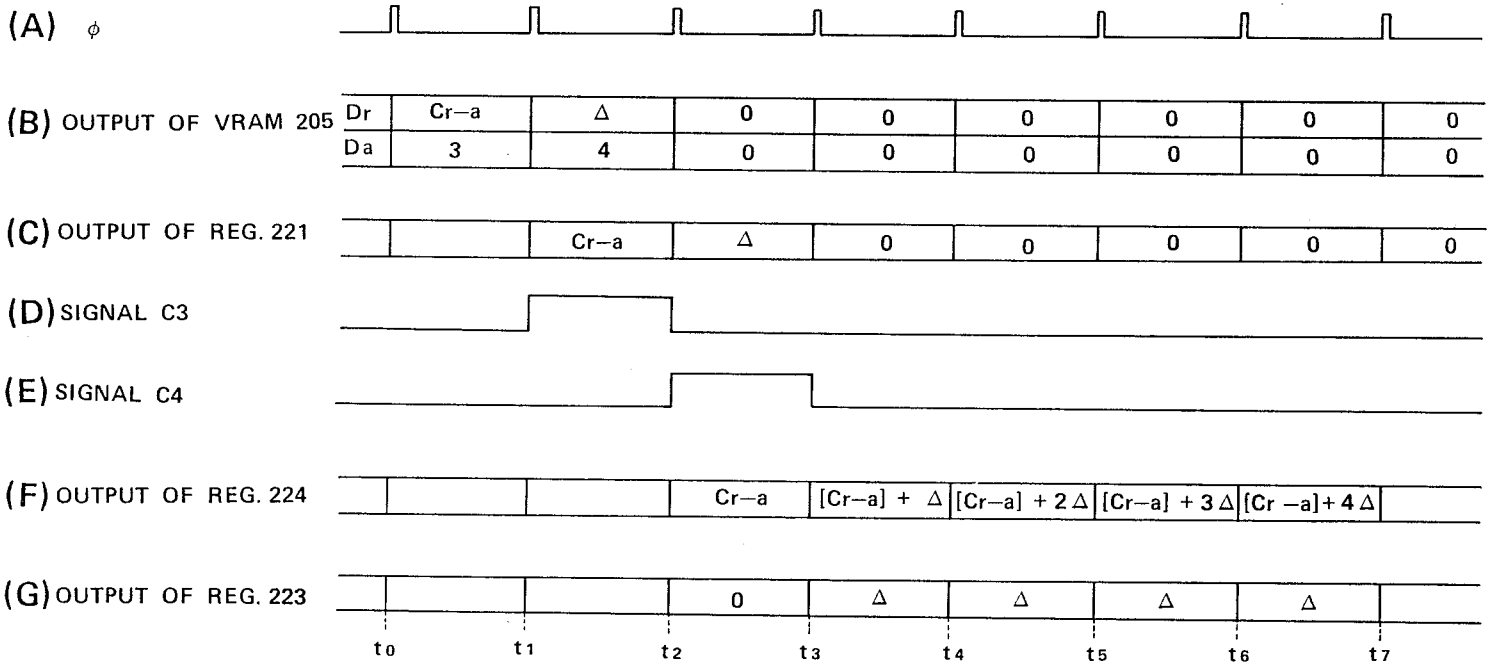
FIG. 15 is a timing chart showing the relationship between the display data which is read from the VRAM 205 of FIG. 8 and variations in the signal generated in the data modifier circuit 212*r* of FIG. 11 and in the outputs of associated registers, when the Gouraud Shading is effected.

The displaying operation performed when the above noted display data are stored in the VRAM 205 will be described below with reference to the timing chart shown in FIG. 15. In the timing chart, part (A) represents the dot clock $\phi$ and part (B) represents the output of the VRAM 205. A time t0 represents the time when the VRAM 205 outputs the display data corresponding to the dot DoK, a time t1 representing the time when the VRAM 205 outputs the display data corresponding to the dot Do(K+1), . . . . When the RAM 205 sequentially outputs the R data Dr shown in part (B) of FIG. 15, the register 221 sequentially outputs the data shown in part (C) of FIG. 15. When the VRAM 205 sequentially outputs the attribute data Da shown in part (B) of FIG. 15, the signals C3 and C4 shown respectively in parts (D) and (E) of FIGS. 15 are output the decoder 214 (FIG. 10). It is assumed here that the register 221 outputs the data Cr-a between the times t1 and t2 shown in FIG. 15. Since the signal C3 is a "1" signal during this time, the data Cr-a is supplied to the input terminal of the register 224 via the multiplexer 237, and is read by the register 224 in response to the dot clock $\phi$ generated at the time t2 (see part (F) of FIG. 15). The thus-read data Cr-a is output as the color data CDr through the multiplexer 238, thereby displaying the dot DoK. Subsequently, data $\Delta$ is read out of the register 221 between the times t2 and t3. Since the signal C4 is a "1" signal during this time, the data $\Delta$ is supplied through the multiplexers 235 and 236 to the adder circuit 242 in which the data $\Delta$ is added to the data Cr-a within the register 224. The result of this addition, i.e., [(Cr−a) +$\Delta$] is supplied to the input terminal of the register 224 through the multiplexer 237. The data $\Delta$ is also supplied to the input terminal of the register 223 through the multiplexer 235. When the following dot clock $\phi$ is output at the time t3, the register 224 reads the aforementioned output [(Cr−a) +$\Delta$] of the adder circuit 242, supplying it as the color data CDr through the multiplexer 238, thereby displaying the dot Do(K+1). At the time t3, as shown in part (G) of FIG. 15, the register 223 also reads the data$\Delta$. When the register 223 outputs the data $\Delta$ between the times t3 and t4, the data $\Delta$ is supplied through the multiplexer 234 to the adder circuit 241 in which the data $\Delta$ is added to the data within the register 222 ("0" in this case). The result of this addition $\Delta$ is supplied through the multiplexers 235 and 236 to the adder circuit 242 in which the result is added to the data [(Cr−a)+$\Delta$] within the register 224. The result [(Cr−a)+2 $\Delta$] obtained by this addition is supplied to the input terminal of the register 224 through the multiplexer 237. When the following dot clock $\phi$ is output at the time t4, the register 224 reads the result [(Cr−a)+2 $\Delta$] , and the dot Do(K +2) is displayed on the basis of the thus-read data. Subsequently, as long as the VRAM 205 continues to output the attribute data Da "0", the above-described operation is repeated, that is, the data $\Delta$ is repeatedly added to the data within the register 224. In consequence, the portion defined between the dots DoK and DoL is displayed in the color which linearly changes.

(iii) Phong Shading (Curvilinear interpolation shading)

This Phong Shading is the operation by which the color of continuous dots is changed in a curved manner. The following description illustratively refers to the color data CDr representative of red (R).

Figure 13:
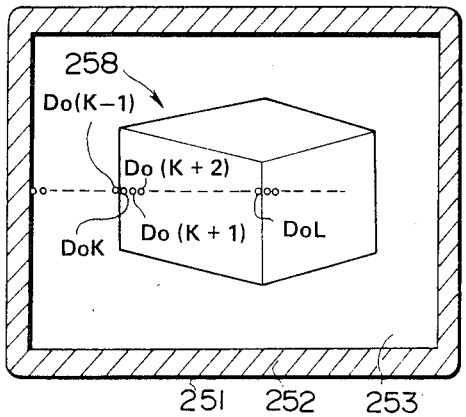
FIG. 13 schematically shows another exmaple of the image displayed on the CRT display unit 208 shown in FIG. 8.
Figure 14:
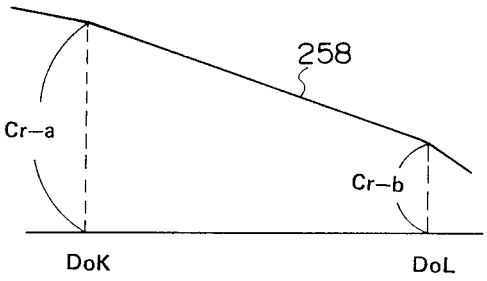
FIG. 14 is a graph showing variations in the color data which is generated by the data modifier circuit 212*r* of FIG. 11 when Gouraud Shading is to be effected.
Figure 16:
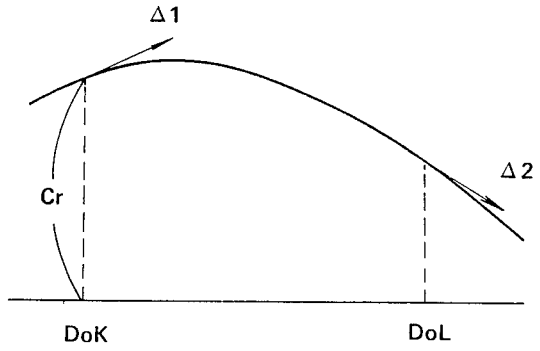
FIG. 16 is a graph showing variations in the color data which is generated by the data modifier circuit 212*r* of FIG. 11 when Phong Shading is to be effected.

It is assumed here that, when the image 258 shown in FIG. 13 is to be displayed, the color of the dots between the dots DoK and DoL is changed in a curved manner as shown in FIG. 16. As shown in FIG. 16 in which the dot DoK is displayed on the basis of the color data Cr, symbol Δ1 represents variations in the color data Cr between the dots DoK and Do(K+1), symbol Δ2 representing variations in the color data Cr between the dots DoL and Do(L+1). In this case, the VRAM 205 is arranged to store the following display data:

the display data corresponding to the dot DoK
Dr=Cr−a, Da=3;

the display data corresponding to the dot Do(K+1)
Dr=Δ1, Da=4; and the display data corresponding to the dot Do(K+2)

$$Dr = \frac{\Delta 2 - \Delta 1}{n} = \Delta^2$$

(where n is the number of the dots between the dots DoK and DoL and the negative number is represented by a complement of that number), Da=7.

Figure 17:
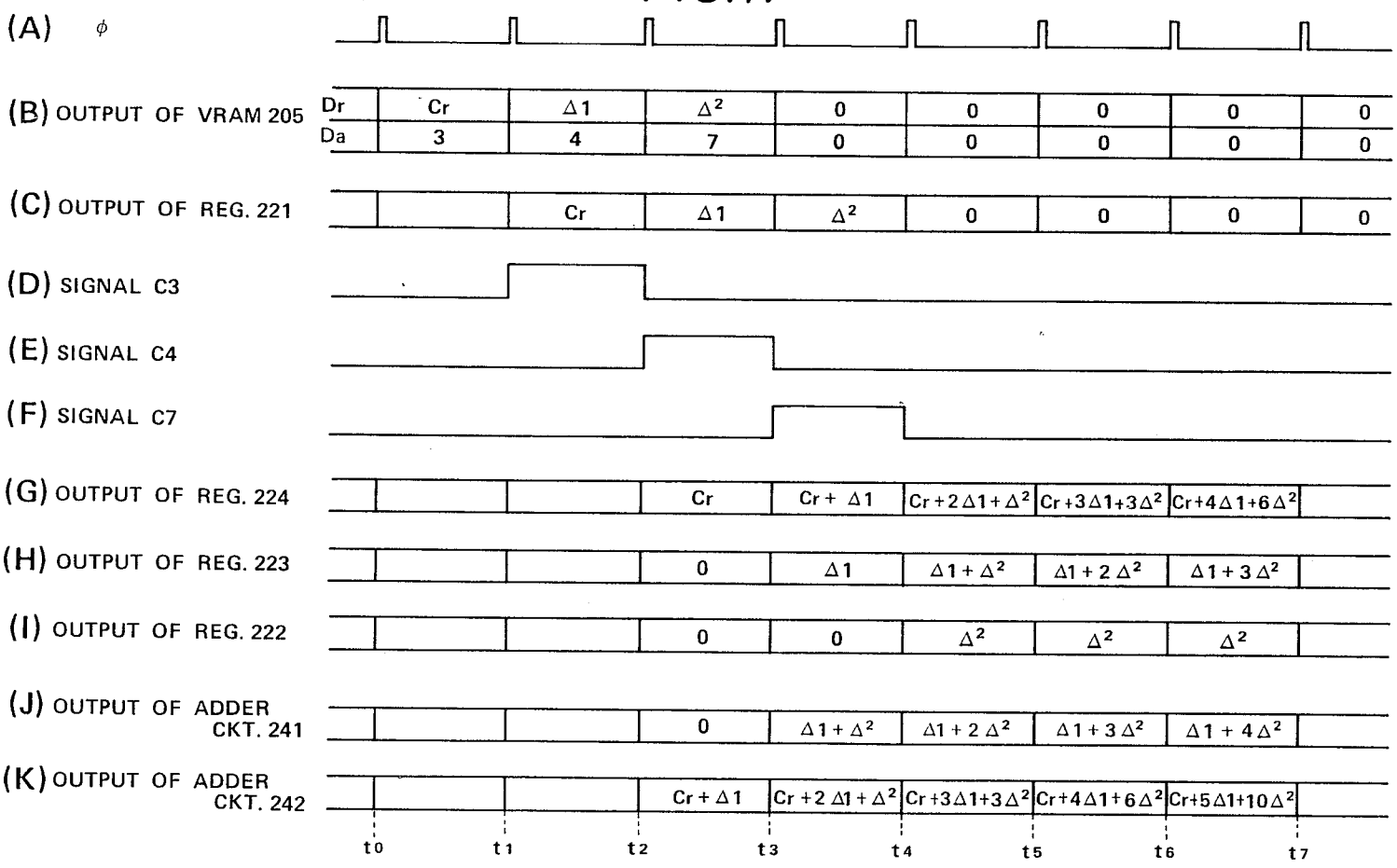
FIG. 17 is a timing chart showing the relationship between the display data which is read from the VRAM 205 of FIG. 8 and variations in the signal generated in the data modifier circuit 212*r* of FIG. 11 and in the outputs of associated registers, when the Phong Shading is to be effected.

The displaying operation of this case will be described with reference to the timing chart shown in FIG. 17. In this Figure, part A shows the dot clock $\phi$, part B the output of the VRAM 205, part C the output of the register 221, part D the signal C3, part E the signal C4 and part F the signal C7.

In the same manner as described above, the register 224 first outputs the data Cr (FIG. 15, part G), and the dot Dok is displayed in color on the basis of the data Cr. At this time, the registers 223, 222 are reset and the registers 223, 222 provide 0 outputs (FIG. 17, parts H, J), thereby forcing the output of the adder circuit 241 (FIG. 17, part J) to goes to a "0". During this time, since the signal C4 is a "1" signal, the data Δ1 within the register 221 is supplied through the multiplexer 235 to the adder circuit 242, and thus the adder circuit 242 provides an output "Cr+Δ1 " (FIG. 17, part K). Subsequently, between the times t3 and t4, the register 224 reads the output data "Cr+Δ1" from the adder circuit 242, and the dot Do(K+1) is displayed in color on the basis of the data "Cr+Δ1". In the meantime, the data Δ1 is read by the register 223, and is supplied to a first input terminal of the adder circuit 241. During this time, since the signal C7 is a "1" signal, the data $\Delta^2$ output by the register 221 is supplied through the multiplexer 233 respectively to the input terminal of the register 222 and to a second input terminal of the adder circuit 241. In consequence, the adder circuit 241 outputs the data "$\Delta 1+\Delta^2$" (FIG. 17, part J), and thus the adder circuit 242 outputs the data "Cr+2 $\Delta 1+\Delta^2$". Subsequently, between the times t4 and t5, the register 224 reads the data "Cr+2 $\Delta 1+\Delta^2$", and the dots Do(K+2) is displayed in color on the basis of the thus-read data. Also, each of the registers 223 and 222 read the data "$\Delta 1+\Delta^2$" and "$\Delta^2$", so that the adder circuit 241 provides an output "$\Delta 1+2\Delta^2$", the adder circuit 242 providing an output "Cr+3 $\Delta 1$+3 $\Delta^2$", Subsequently, the same process is repeated, so that a visual display is performed between the dots DoK and DoL such that color data varies curvilinearly as shown in FIG. 16.

(iv) Step Change Display

Figure 18:
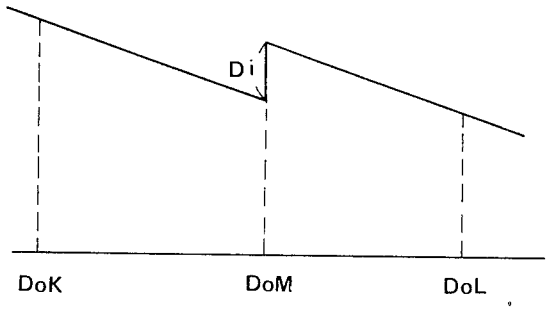
FIG. 18 is a graph showing variations in the color data which is generated by the data modifier circuit 212*r* of FIG. 11 when a step change display described later is carried out in the course of the Gouraud Shading.

The step change display is the operation by which, while a line of dots is being displayed, for example, by the linear interpolation shading, the color of the displayed dots is changed in a stepped manner as shown in FIG. 18.

It is assumed here that color data is changed in a stepped manner by an amount equivalent to Di at a dot DoM between the dots DoK and DoL. (See FIG. 18.) In this case, the VRAM 205 is arranged to store the following display data corresponding to the dot DoM:

Dr=Di and Da=5.

By this arrangement, when the display data corresponding to the dot DoM is read out of the VRAM 205, the data Di is supplied to the adder circuit 242 through the multiplexer 236 in which the data Di is added to the data within the register 224. The register 224 reads the result of this addition. In consequence, the displayed color is changed at the dot DoM in a stepped manner. It should be noted that this step change display can also be applied to the constant shading and the curvilinear interpolation shading as well as the linear interpolation shading.

(v) Direct Display

The direct display is the same displaying method as that of prior-art display apparatus. Specifically, the R, G and B data Dr, Dg and Db within the VRAM 205 are directly used as the color data CDr, CDg and CDb, thereby displaying dots in color.

In this case, the respective storage areas E within the VRAM 205 are arranged to store color data as the R, G and B data Dr, Dg and Db and a "1" as the attribute data Da. Thus, during the displaying operation, the R, G and B data Dr, Dg and Db which are sequentially output by the VRAM 205 are stored in the direct register 225 via the register 221. The data thus stored in the register 225 are output as the color data CDr, CDg and CDb through the multiplexer 238.

In the second preferred embodiment described above, the VRAM 205 is arranged to store the R, G and B data Dr, Dg and Db and the attribute data Da. However, instead of these data, the VRAM 205 may also be arranged to store Y data Dy, U data Du and V data Dv corresponding respectively to luminance data Y and color-difference data U, V. The following description concerns the third preferred embodiment incorporating such data arrangement. As is well known, the luminance data Y and the color-difference data U, V are associated with the R, G and B color data, as given by the following equations.

$$Y = 0.30R + 0.59G + 0.11B \quad (1)$$

$$U = R - Y = 0.70R - 0.59G - 0.11B \quad (2)$$

$$V = B - Y = -0.30R - 0.59G + 0.83B \quad (3)$$

III Third embodiment

Figure 19:
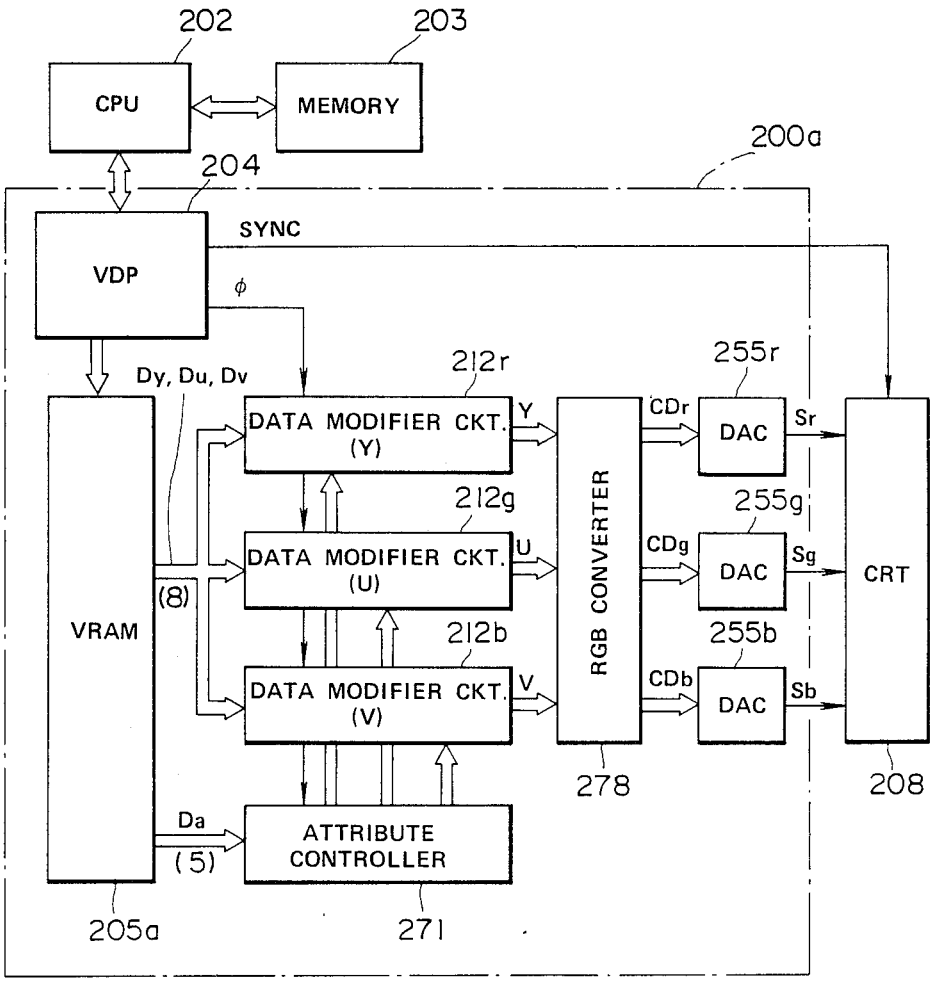
FIG. 19 is a block diagram of a display system which incorporates an image display apparatus 200*a* constituting a third preferred embodiment of the present invention.
Figure 20:
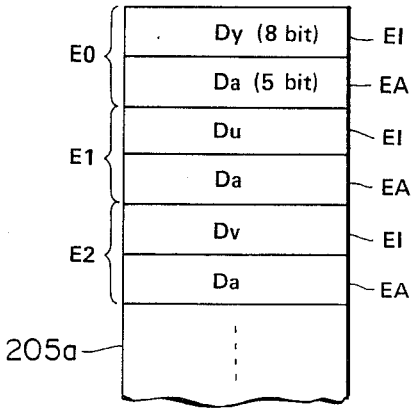
FIG. 20 schematically shows the arrangement of the data which are stored in a VRAM 205*a* of the image display apparatus 200*a* shown in FIG. 19.

FIG. 19 is a block diagram of the entire construction of a color display system which incorporates the image display apparatus **200*a* constituting the third preferred embodiment of the present invention, in which like reference numerals are used for the sake of simplicity to denote like or corresponding elements which constitute each of the components shown in FIG. 8. FIG. 20 is a circuit diagram of the construction of the VRAM 205*a* shown in FIG. 19**.

As shown in FIG. 20, the VRAM **205*a* includes storage areas E0, E1, . . . corresponding to the respective display dots on the CRT display unit 208**, and each of the storage areas E0, E1, . . . is divided into an 8-bit area E1 and a 5-bit area EA. The area EI is arranged to store the Y data Dy, the U data Du or the V data Dv (8 bits for each), while the area EA is arranged to store the attribute data Da (5 bits). At the time of reading, data are read from the areas EI and EA simultaneously.

In this fashion, the third preferred embodiment is arranged to store any one of the data Dy, Du and Dv in correspondence with one dot to be displayed, and this provides a reduction in the capacity of the VRAM 205*a*. The reasons for this reduction being enabled are as follows: (a) since the color-difference data U, V change at relatively low frequencies, it is unnecessary to provide data in correspondence with each dot and it is sufficient to provide a piece of data for each group of several dots; and (b) since the data modifier circuits 212*r*, 212*g* and 212*b* are provided, no large hindrance occurs even though the luminance data Y is not prepared in correspondence with each dot. However, it is necessary to determine which of the data Dy, Du or Dv is output by the VRAM 205*a*. Therefore two bits are added to the attribute data Da to constitute the data Da in 5-bit form. The 2 bits added are hereinafter referred to as "EF (element field) bits" while the original 3 bits are referred to as "MF (modify) bits". The EF bits are associated with the data Dy, Du and Dv as follows.

| EF | DATA |
|---|---|
| 0 | Dy |
| 1 | Du |
| 2 | Dv |

Figure 21:
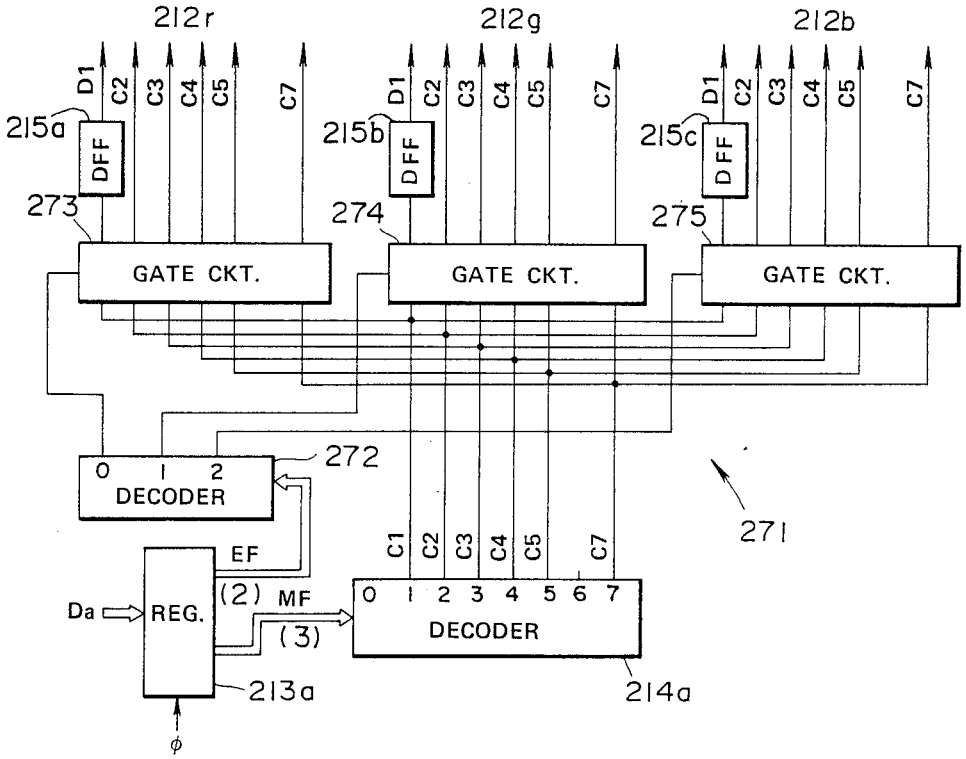
FIG. 21 is a logic diagram of an attribute controller 271 of the image display apparatus 200*a* shown in FIG. 19.

In accordance with this relationship, the data Dy, Du and Dv output by the VRAM 205*a* are supplied in parallel with one another to the data modifier circuits 212*r*, 212*g* and 212*b* (FIG. 19), respectively, while the attribute data Da is supplied to an attribute controller 271. FIG. 21 is a block diagram of the construction of the attribute controller 271. The attribute data Da is read by a register 213*a* shown in FIG. 21 at the timing provided by the dot clock $\phi$, and the MF bits and the EF bits are supplied to the decoders 214*a* and 272, respectively. As described in the second preferred embodiment, the decoder 214*a* decodes the MF bits, and outputs signals C1, C2, C3, C4, C5 and C7 in accordance with the result of this decoding. These signals C1 to C7 are supplied to each of gate circuits 273, 274 and 275. The decoder 272 controls the opening and closing of the gate circuits 273, 274 and 275, and is arranged to selectively open the following three gate circuits: the gate circuit 273 when the EF bits represent "0"; the gate circuit 274 when the EF bits represent "1"; and the gate circuit 275 when the EF bits represent "2". When the gate circuit 273 is opened, the signal C1 is allowed to pass the circuit 273, delayed by one cycle of the dot clock $\phi$ by means of a DFF 215*a* and supplied to the data modifier circuit 212*r* in the form of the signal D1. The signals C2, C3, C4, C5 and C7 are also allowed to pass the gate circuit 273, being supplied to the data modifier circuit 212*r*. Similarly, when the gate circuit 274 is opened, the signals D1, C2, C3, C4, C5 and C7 are supplied to the data modifier circuit 212*g*; whereas, when the gate circuit 275 is opened, the signals D1, C2, C3, C4, C5 and C7 are supplied to the data modifier circuit 212*b*. The operation of each of the data modifier circuits 212*r*, 212*g* and 212*b* based on these signals D1 to C7 are completely the same as that of the second preferred embodiment, so the detailed description will be omitted.

Subsequently, the output of each of the data modifier circuits 212*r*, 212*g* and 212*b* is supplied to an RGB converter 278 in the form of the luminance data Y, the color-difference data U and the color-difference data V. The RGB converter 278 converts the luminance data Y and the color-difference data U, V into the color data CDr, CDg and CDb on the basis of the previously noted equations (1), (2) and (3), and thus outputs them to the DACs 255*r*, 255*g* and 255*b*, respectively. The DACs 255*r*, 255*g* and 255*b* convert the color data CDr, CDg and CDb respectively into the analog color video signals Sr, Sg and Sb, and thus output them to the CRT display unit 208.

IV Fourth embodiment

In the second preferred embodiment, the VRAM 205 is arranged to store the data Dr, Dg and Db in correspondence with the color data Dr, Dg and Db as well as the attribute data Da. However, instead of these data, in the same manner as the first preferred embodiment, the VRAM 205 could also be arranged to store a color code corresponding to each dot to be displayed. A fourth embodiment of the invention is provided in accordance with this arrangement.

Figure 22:
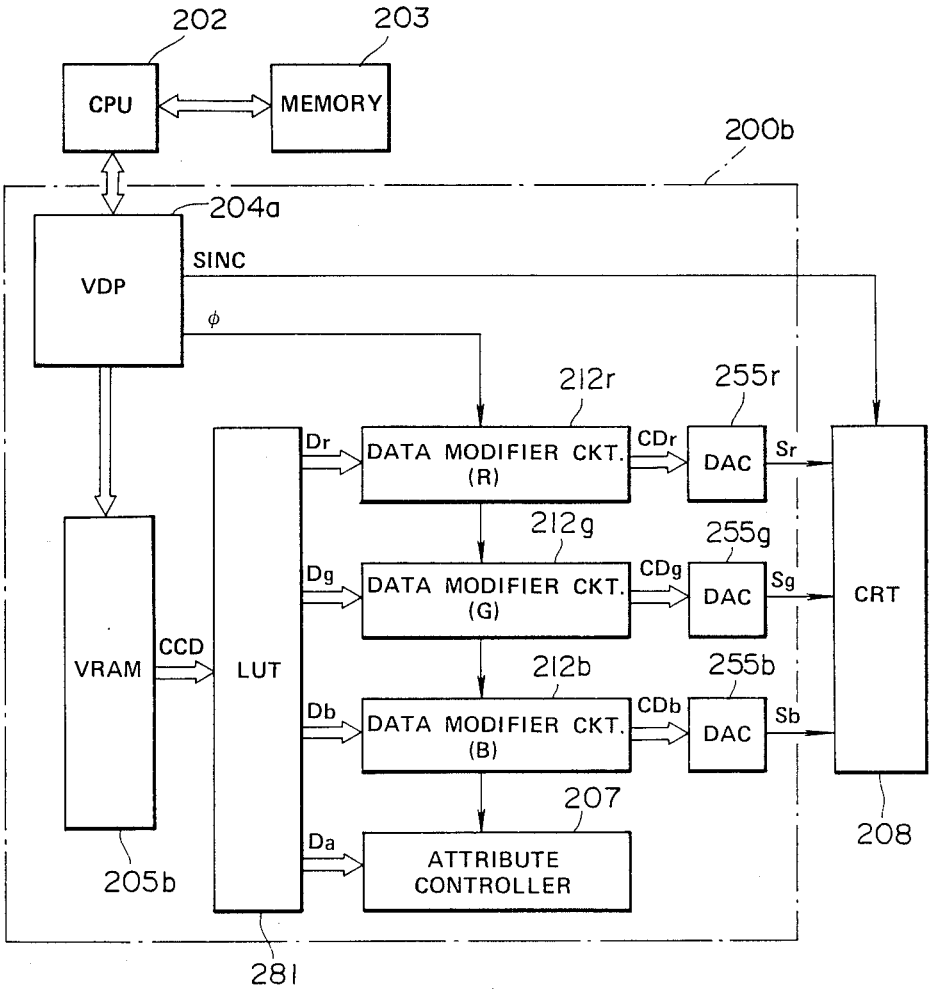
FIG. 22 is a block diagram of a display system which incorporates an image display apparatus 200*b* constituting a fourth preferred embodiment of the present invention.

Referring to FIG. 22 showing a block diagram of the construction of the fourth preferred embodiment, the color code CCD read from the VRAM 205b is supplied to an LUT 281. In the same manner as the previously described RAM 111, the LUT 281 stores the R, G and B data Dr, Dg, Db and the attribute data Da in correspondence with the respective color codes. When the color code CCD is supplied to the LUT 281, the data Dr, Dg, Db and Da corresponding to the color code CCD are output from the LUT 281 to the data modifier circuits 212*r*, 212*g*, 212*b* and the attribute controller 207, respectively. It will be appreciated that such arrangement can be applied to the third preferred embodiment.

V Fifth embodiment

In the second preferred embodiment described previously, the bit number of each color data stored in the VRAM 205 is a "8". Therfore, although $2^8 \times 2^8 \times 2^8 \times = 2^{24}$ colors can be displayed in accordance with the second embodiment, the capacity of the VRAM 205 needs to be remarkably increased. In the fifth preferred embodiment of the present invention which is shown in FIG. 23 and which is described later, the number of colors which can be displayed is increased, and yet the storage capacity of the VRAM can be greatly reduced.

V-1 Construction of fifth embodiment

Figure 23:
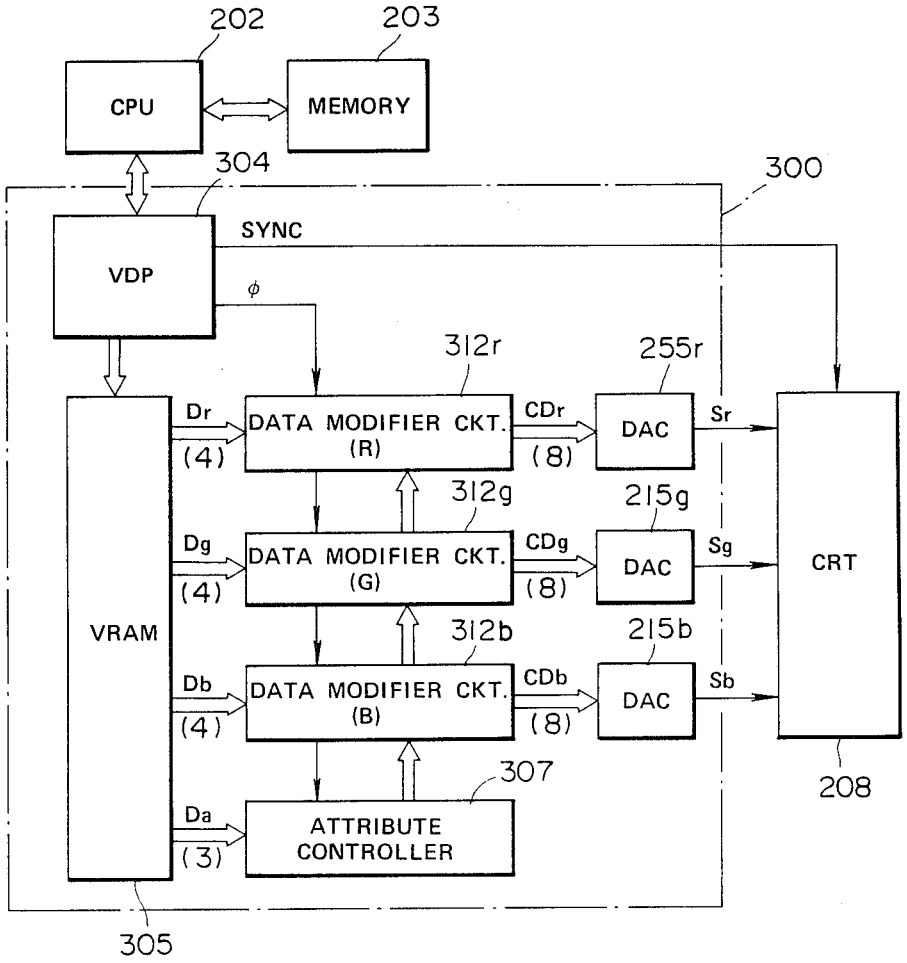
FIG. 23 is a block diagram of a display system which incorporates an image display apparatus 300 constituting a fifth preferred embodiment of the present invention.

FIG. 23 is a block diagram of a display system which incorporates the image display apparatus 300 constituting the fifth embodiment, in which like reference numerals are used for the sake of simplicity to denote like or corresponding elements which constitute each of the components shown in FIG. 8.

Figure 24:
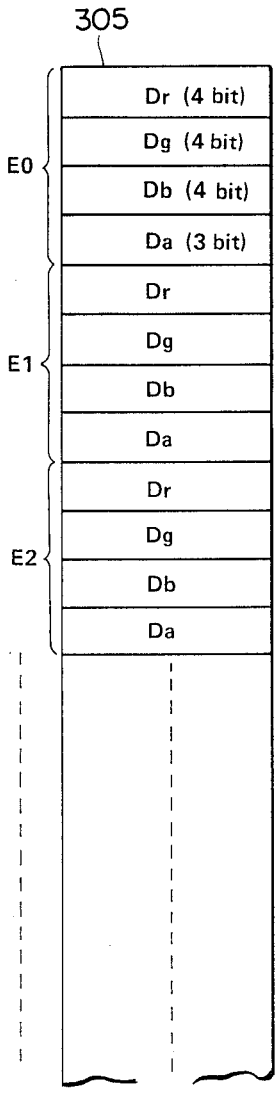
FIG. 24 schematically shows the arrangement of the display data stored in a VRAM 305 forming part of the image display apparatus 300 shown in FIG. 23.

As shown in FIG. 24, the VRAM 305 includes the storage areas E0, E1, . . . (15 bits for each area) in correspondence with the respective dots to be displayed on the CRT display unit 208, and each of the storage areas E0, E1, . . . stores a set of data corresponding to each dot to be displayed, such as the R data Dr, the G data Dg, the B data Db (in 4-bit form) as well as the attribute data Da (in 3-bit form). A VDP 304 writes the display data output by the CPU 202 into the VRAM 305. The VDP 304 has the same construction as the previously-described VDP 204 by which the display data from each of the storage areas E0, E1, . . . of the VRAM 305 is sequentially and repeatedly read at the timing provided by the dot clock $\phi$. The thus-read data Dr, Dg, Db and Da are respectively supplied to data modifier circuits 312*r*, 312*g*, 312*b* and an attribute controller 307.

The data modifier circuits 312*r*, 312*g* and 312*b* respectively generate the color data CDr, CDg and CDb (8 bits for each) on the basis of the data Dr, Dg and Db (4 bits for each) which are output by the VRAM 305, and thus outputs them respectively to the DACs 255*r*, 255*g* and 255*b*.

Figure 25:
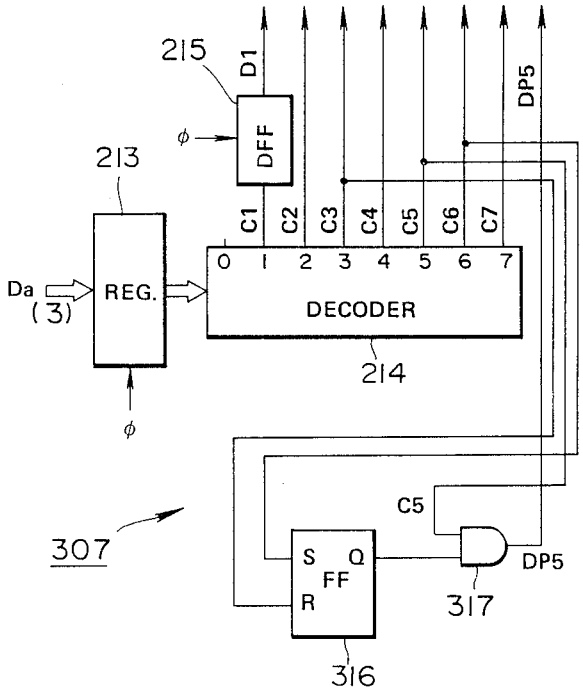
FIG. 25 is a logic diagram of an attribute controller 307 forming part of the image display apparatus 300 shown in FIG. 23.

Although the attribute controller 307 shown in FIG. 25 is substantially the same as the attribute controller of FIG. 10, they differ from each other in the following respects.

Specifically, the attribute controller 307 is provided with: a flip-flop (FF) 316 which is set in response to the output signal C6 of the decoder 214 and which is reset in response to the output signal C3 of the decoder 214; and an AND gate 317 having one input terminal receiving an output signal from the FF 316 and the other input terminal receiving the output signal C5 from the decoder 214. The output signal DP 5 of the AND gate 317 is supplied to each of the data modifier circuits 312*r*, 312*g* and 312*b* in a parallel manner.

The data modifier circuit 312*r* is similar to the data modifier circuit 212*r* shown in FIG. 11, but they differ from each other in the following respects.

Figure 26:
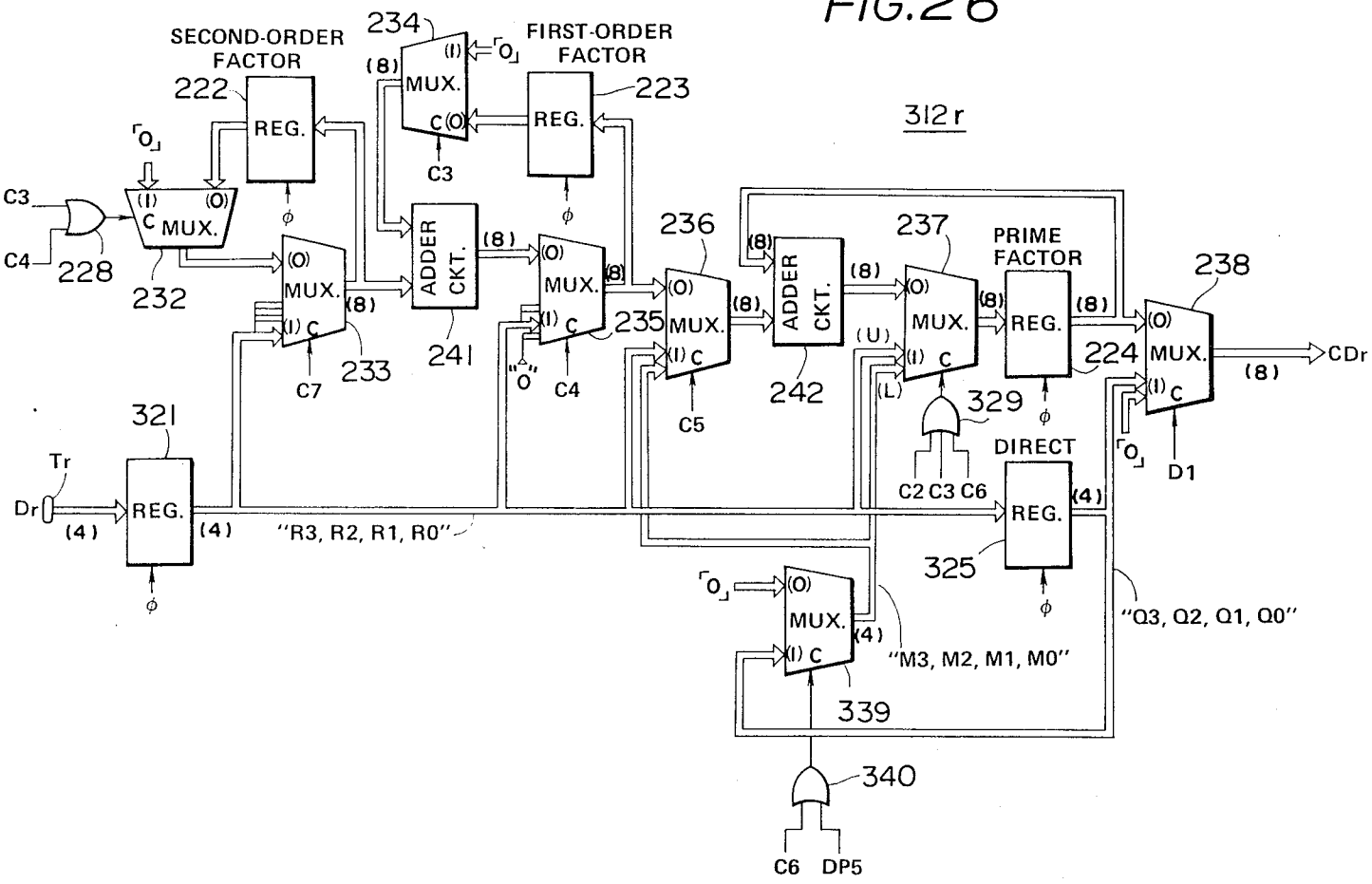
FIG. 26 is a logic diagram of a data modifier circuit 312*r* forming part of the image display apparatus 300 shown in FIG. 23.

Specifically, as shown in FIG. 26, registers 321 and 325 are 4-bit registers. When any one of the signals C2, C3 and C6 is a "1", the OR gate 329 supplies the "1" signal to the control terminal C of the multiplexer 237. Moreover, the data modifier circuit 312*r* is provided with: an OR gate 340 which outputs a "1" signal when the signal C6 or the DP5 assumes the "1" state; and a 4-bit multiplexer 339 which is controlled by the output signal of the OR gate 340. The data provided at the input terminal <I> of each of the multiplexers 233, 235, 236, 237 and 238 is as follows.

TABLE 1

| MSB | | | | | | | LSB |
|---|---|---|---|---|---|---|---|
| 233: R3 | R3 | R3 | R3 | R3 | R2 | R1 | R0 |
| 235: R3 | R3 | R3 | R2 | R1 | R0 | 0 | 0 |
| 236: R3 | R2 | R1 | R0 | M3 | M2 | M1 | M0 |
| 237: R3 | R2 | R1 | R0 | M3 | M2 | M1 | M0 |
| 238: Q3 | Q2 | Q1 | Q0 | 0 | 0 | 0 | 0 |

In Table 1, R3, R2, R1 and R0 (R0 ; LSB) represent the bits of the data output by the register 321; M3, M2, M1 and M0 (M0 ; LSB) represent the bits of the data output by the multiplexers 339; and Q3, Q2, Q1 and Q0 represent the bits of the data output by the register 325.

As an example, when the above noted data are to be supplied to the input terminal <I> of the multiplexer 235, its zeroth bit and first bits are grounded, its second to fifth bits are connected to the output terminal of the register 321, and its fifth to seventh bits are short-circuited.

V-2 Operation of data modifier circuit of fifth embodiment

The operation of the data modifier circuit 312*r* will be described below. The circuit 312*r* operates in accordance with the attribute bit data Da listed below.

0: Non Modulation
1: Direct Display
2: Load Prime
3: Load Prime with Reset
4: Load First
5: Load Step
6: Load Double Precision
7: Load Second The above operations will be described below.

(i) Direct Display (Da="1")

When the VRAM 305 outputs the attribute data Da "1", the signal C goes to a "1" signal. The thus-obtained "1" signal is supplied as the signal D1 to the multiplexer 238 shown in FIG. 26. In the meantime, the R data Dr which is output by the VRAM 305 simultaneously with the attribute data Da "1" is read by the register 321 shown in FIG. 26 in response to the dot clock $\phi$, and then is read by the register 325, thus being supplied to the higher-order 4 bits of the input terminal <I> of the multiplexer 238. Specifically, two cycles of the dot clock $\phi$ after the time when the VRAM 305 outputs the R data Dr, this R data Dr is supplied to the higher-order 4 bits of the input terminal <I> of the multiplexer 238. At this time, since the signal D1 is a "1" signal as previously mentioned, the R data Dr is output from the multiplexer 238 in the form of the 8-bit data shown in Table 1, and the thus-obtained data is supplied as the color data CDr to the DAC 255*r*.

(ii) Load Prime (Da="2")

When the VRAM 305 outputs the attribute bit data Da "2", the signal C2 goes to a "1" signal after the passage of one cycle of the dot clock $\phi$. The thus-obtained "1" signal is supplied to the multiplexer 237 through the OR gate 329 (FIG. 26). In the meantime, the R data Dr which is output together with the attribute data Da "2" by the VRAM 305 is output from the register 321 after the passage of one cycle of the dot clock $\phi$, then being supplied to the higher-order 4 bits of the input terminal <I> of the multiplexer 237. At this time, since the signal C6 is a "0" signal, the data "0" provided at the input terminal <0> of the multiplexer 339 is output therefrom and is supplied to the lower-order 4 bits of the input terminal <I> of the multiplexer 237. In consequence, the multiplexer 237 supplies the data "R3, R2, R1, R0, 0, 0, 0, 0" to the input terminal of the prime factor register 224, and then is read by the prime factor register 224 at the timing provided by the following dot clock $\phi$. The thus-read data is output as the color data CDr through the multiplexer 238.

In this fashion, when the attribute bit data Da represents "2", the register 224 reads 8-bit data including the R data Dr as higher-order 4 bits and the data "0" as lower-order 4 bits.

(iii) Load Prime with Reset (Da="3")

When the VRAM 305 outputs the attribute data Da "3", the signal C3 goes to a "1" signal after the passage of one cycle of the dot clock $\phi$. The thus-obtained "1" signal is supplied to the multiplexer 237 through the OR gate 329 and to the multiplexer 234, and further to the multiplexer 232 through the OR gate 228. In consequence, in the same manner as described previously, the prime factor register 224 reads the data "R3, R2, R1, R0, 0, 0, 0, 0". Specifically, when the VRAM 305 outputs the attribute data Da "3", the register 224 reads the above data and the registers 222, 323 are reset.

(iv) Load First (Da="4")

When the VRAM 305 outputs the attribute data Da "4", the signal C4 goes to a "1" signal after the passage of one cycle of the dot clock $\phi$. The thus-obtained "1" signal is supplied to the multiplexer 235 and through the OR gate 228 to the multiplexer 232. On the other hand, the R data Dr which is output by the VRAM 305 together with the attribute data Da "4" is output from the register 321 after the passage of one cycle of the dot clock $\phi$, and is supplied to second to fifth bits of the input terminal <I> of the multiplexer 235. At this time, since the signal C4 is a "1" signal, the 8-bit data shown in Table "1" is output from the multiplexer 235, and then is read by the register 223 at the timing provided by the following dot clock $\phi$. Also, when the signal C4 goes to a "1" signal, the register 222 is reset.

(v) Load Step (Da="5")

When the VRAM 305 outputs the attribute data Da "5", the signal C5 goes to a "1" signal. The thus-obtained "1" signal is supplied to the AND gate 317 (FIG. 25) and the multiplexer 236 (FIG. 26). At this time, if the flip-flop 316 shown in FIG. 25 is not set, the AND gate 317 is closed, so that the signal C5 (a "1" signal) output to the AND gate 317 does not affect the operation of the circuitry. On the other hand, when the signal C5 (a "1" signal) is supplied to the multiplexer 236, the multiplexer 236 outputs data including the R data Dr within the register 321 as higher-order 4 bits and the data "0" output by the multiplexer 339 as lower-order 4 bits. The thus-output data is supplied to the adder circuit 242 in which it is added to the content of the prime factor register 224. The result of this addition is supplied to the input terminal of the prime factor register 224 through the multiplexer 237, and then is read by the register 224 at the timing provided by the following dot clock $\phi$.

When the flip-flop 316 shown in FIG. 25 is set, the signal DP5 goes to a "1" signal if the signal C5 becomes "1". The thus-obtained "1" signal is supplied to the multiplexer 339 through the OR gate 340 (FIG. 26). In consequence, the output data of the register 325 is supplied to the lower-order 4 bits of the multiplexer 236 through multiplexer 339. Specifically, where the flip-flop 316 is set, when the signal C5 goes to a "1" signal, the multiplexer 236 outputs data including: the R data Dr within the register 321 as higher-order 4 bits; and the R data Dr within the register 325 as lower-order 4 bits. The thus-output data is supplied to the adder circuit 242 in which it is added to the content of the the prime factor register 224. The result of this addition is supplied to the input terminal of the prime factor register 224 through the multiplexer 237, then being read by the register 224 at the timing provided by the following dot clock $\phi$. Incidentally, the data within the register 325 is the data which is supplied by the VRAM 305 one cycle of the dot clock $\phi$ before the arrival of data at the register 321.

(vi) Load Double Precision (Da="6")

When the VRAM 305 outputs the attribute data Da "6", the signal C6 goes to a "1" signal after the passage of one cycle of the dot clock $\phi$. The thus-obtained "1" signal is supplied to the control terminal C of the multiplexer 339 through the OR gate 340, and through the OR gate 329 to the control terminal C of the multiplexer 237. When the "1" signal is supplied to the control terminal C of the multiplexer 339, the data within the register 325 is supplied through the multiplexer 339 to the lower-order 4 bits of the multiplexer 237. On the other hand, the R data Dr which is output together with the attribute data Da "6" is output from the register 321 after the passage of one cycle of the dot clock $\phi$, then being supplied to the higher-order 4 bits of the multiplexer 237. At this time, since the "1" signal is supplied to the control terminal C of the multiplexer 237 as described previously, the multiplexer 237 outputs the 8-bit data composed of the data output by the register 321 and the data output by the register 325, thus the 8-bit data being read by the register 224 at the timing provided by the dot clock $\phi$. The data stored in the register 224 is output as the color data CDr via the multiplexer 238.

(vii) Load Second (Da="7")

When the VRAM 305 outputs the attribute data Da"7", the signal C7 goes to a "1" signal. The thus-obtained "1" signal is supplied to the multiplexer 233. In consequence, the R data Dr which is read by the register 321 is supplied through the multiplexer 233 to the input terminal of the second-order factor register 222 in the form of the 8-bit data shown in Table 1. This data is read by the register 222 at the timing provided by the following dot clock $\phi$.

(viii) Non Modulation (Da="0")

This operation is the same as the operation of the second preferred embodiment described previously. Therefore, where the VRAM 305 continuously outputs the attribute data Da "0", the output of the adder circuit 241 is sequentially added to the data within the register 224 at the timing provided by the dot clock $\phi$. Thus, the result of this addition is sequentially output as the color data CDr. In this fashion, when the attribute bit data Da is a "0", the color data CDr is the data which is independent of the R data Dr output by the VRAM 305.

The above description has been made with respect to the operation of the data modifier circuit 312*r* corresponding to the attribute data Da. Incidentally, the operations of the data modifier circuits 312*g*, 312*b* are completely the same as that of the circuit 312*r*.

V-3 Overall operation of fifth embodiment

The operation of the fifth preferred embodiment will be described below with illustrative reference to the case wherein the sole red is used as display color.

(i) Constant Shading

By way of example, the following explanation will be made of the case where, in the image displaying region 253 shown in FIG. 12, the image 256 is displayed in the color corresponding to the R color data CDr "11110000" and the background color is specified on the basis of the R color data Cdr="10100000". The CPU 202 first clears the VRAM 305, and then writes the R data Dr "1010" (4 bits for each) and the attribute data Da "3" (011) into the storage area E (shown in FIG. 24) corresponding to each dot contained in the leftmost dot column d1 in the image displaying region 253. Secondly, the CPU 202 writes the R data Dr "1111" and the attribute data Da "3" into the storage area E corresponding to each of the dots contained in the respective dot lines d2, d4 at the left of the image 256. Subsequently, the CPU 202 writes the R data Dr "1010" and the attribute data Da "3" into the storage area E corresponding to each dot contained in the dot lines d3, d5 at the right in the image displaying region 256. Finally, the CPU 202 issues a display command. When the display command is issued, display data is sequentially read out of the VRAM 305, in a sequence starting from the display data Dr, Dg, Db and Da corresponding to the leftmost dot in the uppermost line of the image display region 253 and at the timing provided by each dot clock $\phi$. Based on the thus-obtained data, each dot is displayed in color. This display operation will be described with illustrative reference to the dot line 257 shown in FIG. 12. Incidentally, since the data Dr, Db are normally "0"s in this example, the descriptions of the data Dg, Db will be omitted.

First, the VRAM 305 outputs the display data corresponding to the leftmost dot Do1 on the dot line 257. This display data has the R data Dr "1010" and the attribute data Da "3". Therefore, two cycles of the dot clock $\phi$ after this data output, the registers 222 and 223 within the data modifier circuit 312*r* are reset, and the data "10100000" is read by the prime factor register 224. The thus-read data is supplied to the DAC 255*r* through the multiplexer 238 in which it is converted into the color video signal Sr, then being supplied to the CRT display unit 208. In consequence, the leftmost dot Do1 of the dot line 257 is displayed in the color corresponding to the color data "10100000". Secondly, the VRAM 305 outputs the display data corresponding to the second leftmost dot Do2 of the dot line 257. Both the R data Dr and the attribute data Da are "0"s in this display data. Therefore, two-dot clock time after the time when the VRAM 305 outputs this display data, the register 224 reads the sum of the data within the register 224 and the output of the multiplexer 236. In this case, since the data within the registers 222, 223 are "0"s, the data within the register 224 is not changed, so that the second dot Do2 is displayed in the same color as that of the first dot Do1. Similarly, a third dot Do3, a fourth dot Do4, . . . are respectively displayed in the same color as that of the dot Do1.

Secondly, the display data corresponding to the dot DoK shown in FIG. 12 is read from the VRAM 305. This display has the R data Dr "1111" and the attribute data Da "3". Therefore, in the same manner as the dot Do1, the dot DoK is displayed in the color corresponding to the color data "11110000", and the registers 222, 223 are again cleared. Similarly, the dot Do(K+1), Do(K+2), . . . are sequentially displayed in the same color as that of the dot DoK.

Thirdly, when the display data corresponding to the dot DoM is read from the VRAM 305, the dot DoM is displayed in the color corresponding to the color data "10100000" in the same manner as described above. Subsequently, the remaining dots in the dot line 257 are respectively displayed in the same color as that of the dot DoM. The above description has been made with respect to the entire process of the dot line 257 being displayed in color, and the other dot lines are also displayed in color in the same manner. (ii) Gouraud Shading (linear interpolation shading)

Figure 27:
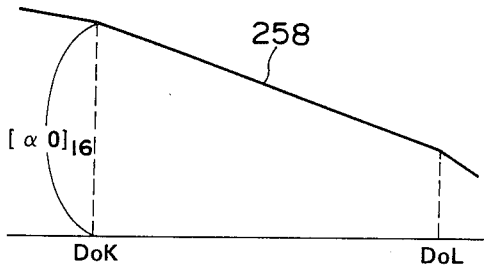
FIG. 27 is a graph showing variations in the color data which is generated by the data modifier circuit 312*r* shown in FIG. 26, when the Gouraud Shading is to be effected.

The following explanation will be made of the case where the image 258 shown in FIG. 13 is to be displayed in color. It is assumed here that the shown dot DoK is displayed on the basis of the color data "$\alpha$0" (hexadecimal number) and that the colors of the dots between the dots DoK and DoL are linearly changed as shown in FIG. 27. In this case, the VRAM 305 is arranged to store the following display data:

the display data corresponding to the dot DoK
Dr=$\alpha$,
Dr=3;
the display data corresponding to the dot Do (K+1)
Dr=$\Delta$(a negative number is represented by a complement of that number)
Da=4
(where $\Delta$ is the data representative of the inclination of the line shown in FIG. 27); and
the display data corresponding to the dots between Do (k+2) and (DoL)
Dr=0,
Da=0.

Figure 28:
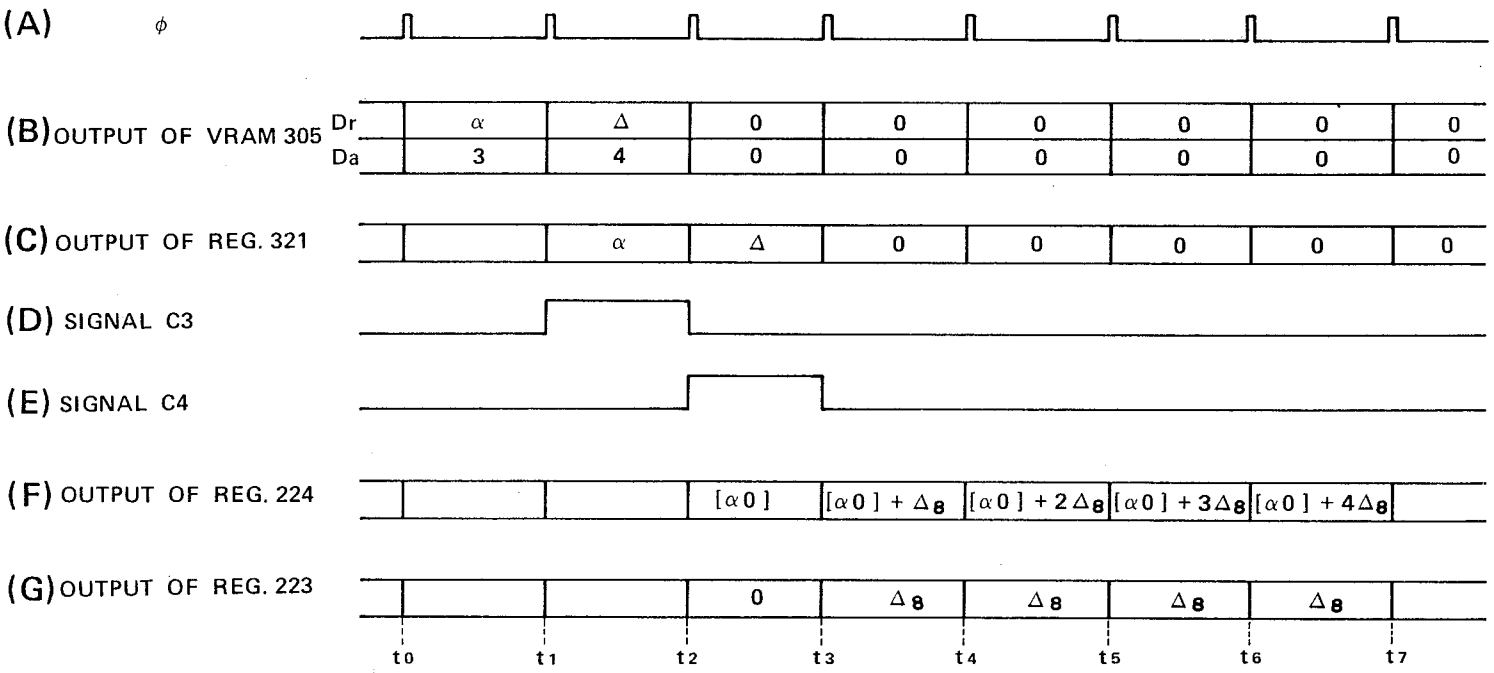
FIG. 28 is a timing chart showing the relationship between the display data which are read from the VRAM 305 of FIG. 23 and variations in the signal generated in the data modifier circuit 312*r* of FIG. 26 and in the outputs of associated registers, when the Gouraud Shading is to be effected.

The displaying operation based on the above-described display data is performed in accordance with the timing chart shown in FIG. 28. Specifically, data "$\alpha$" is read from the VRAM 305 together with the attribute data Da "3", and this data "$\Delta$" is read by the register 224 in the form of the data "$\Delta$0". Also, data "$\Delta$" is read from the VRAM 305 together with the attribute data Da "4", and this data "$\Delta$" is written into the register 223 in the form of the 8-bit data output by the multiplexer 235 shown in Table "1" (this 8-bit data is referred to simply as "$\Delta_8$"), such data being added to the content (or data "$\alpha$0") of the register 224. Where the attribute data Da "0" and the data "0" are read from the VRAM 305, the content of the register 223, i.e., the data "$\Delta$8" is added to the content of the register 224. Specifically, the data within the register 224 is linearly changed in the order of "$\alpha$0", "$\Delta$0+$\Delta$8", "$\Delta$0+2 $\Delta$8", . . . , and, on the basis of these data, the portion between the dots DoK and DoL are displayed.

(iii) Phong Shading (Curvilinear interpolation shading)

Figure 29:
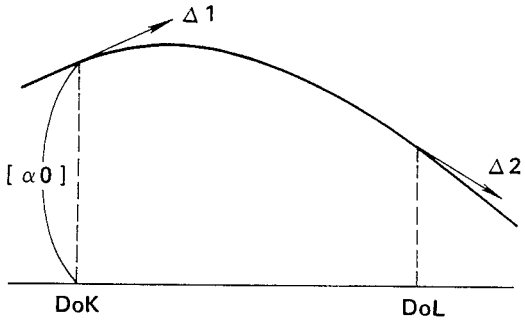
FIG. 29 is a graph showing variations in the color data generated by the data modifier circuit 312*r* of FIG. 26 when the Phonge Shading is to be effected.

As an example, when the image 258 shown in FIG. 13 is to be displayed, the colors of the dots between the dots DoK and DoL are assumed to be changed curvilinearly as shown in FIG. 29. As shown in FIG. 29 in which the dot Dok is displayed on the basis of the color data "$\alpha$0", symbol "$\Delta$1" (4 bits) represents variations in the color data between the dots Dok and Do (K+1), symbol "$\Delta$2" (4 bits) representing variations in the color data between the dots DoL and Do (L+1). In this case, the VRAM 305 is arranged to store the following display data:

the display data corresponding to the dot DoK
Dr=$\alpha$,
Dr=3;
the display data corresponding to the dot Do (K+1)
Dr=$\Delta$1,
Da=4; and
the display data corresponding to the dot Do (K+2)

$$Dr = \frac{\Delta 2 - \Delta 1}{n} = \Delta^2$$

(where n is the number of the dots between the dots DoK and DoL, the negative number is represented by a complement of that number, and the $\Delta^2$ is represented by 4 bits) Da=7.

Figure 30:
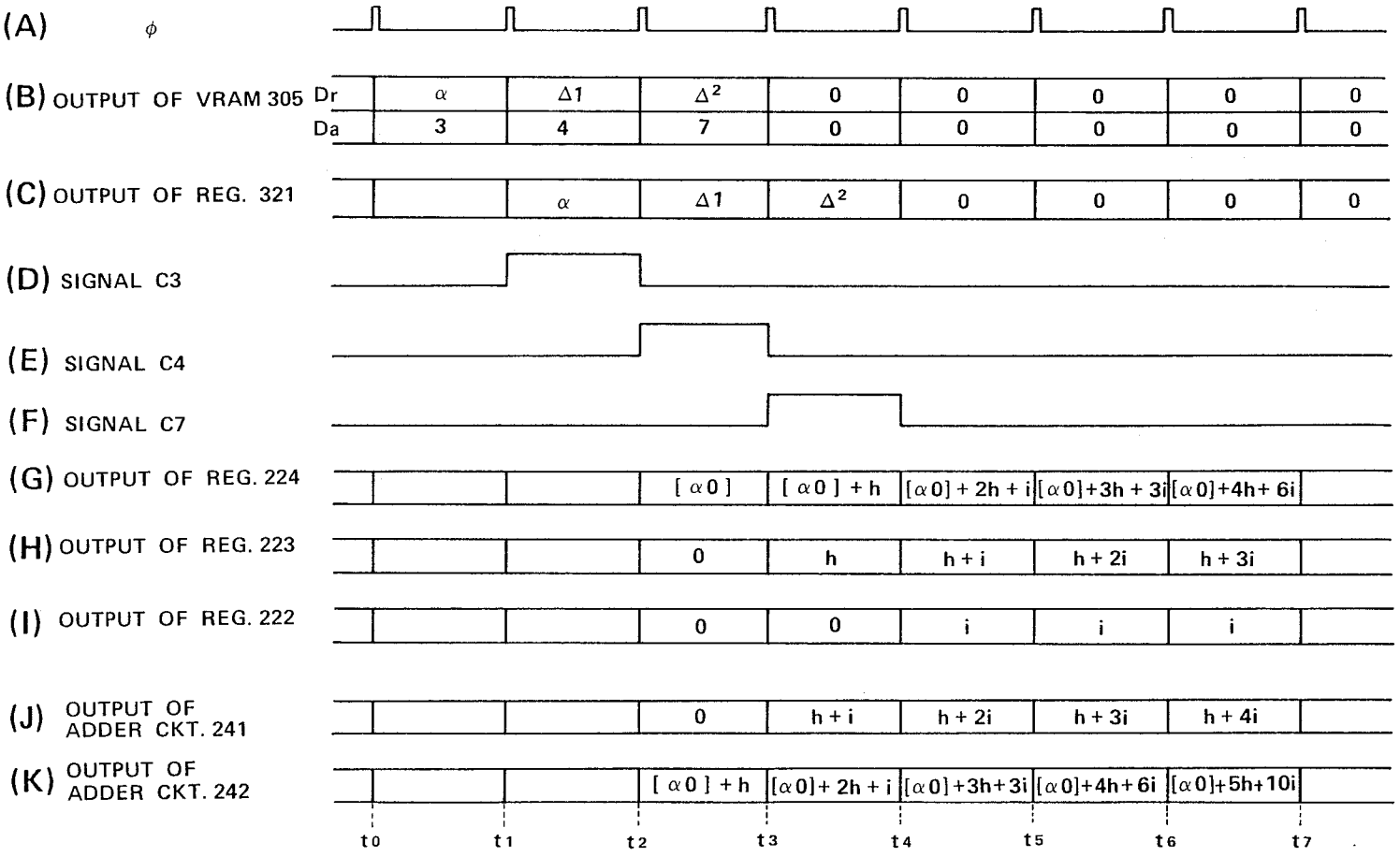
FIG. 30 is a timing chart showing the relationship between the display data which are read from the VRAM 305 of FIG. 23 and variations in the signal generated in the data modifier circuit 312*r* of FIG. 26 and in the outputs of associated registers, when the Phong Shading is to be effected.

The displaying operation based on the above noted display data is performed in accordance with the timing chart shown in FIG. 30. Specifically, the data "$\alpha$" is read from the VRAM 305 together with the attribute data Da "3", and this data "$\alpha$" is read by the register 224 in the form of the data "$\alpha$0". Also, the data "$\Delta$1" is read from the VRAM 305 together with the attribute data Da "4", and this data "Δ" is written into the register 223 in the form of 8-bit data output by the multiplexer 235 shown in Table "1" (hereinafter referred to as "h"), being added to the content (the data "α0") of the register 224. In consequence, the content of the register 224 becomes "α0+h". Next, the data "$\Delta^2$ which is read from the VRAM 305 together with the attribute data Da "7" is written into the register 222 in the form of 8-bit data (hereinafter referred to as "i"), being added to the content of the register 223. This data together with the content of the register 223 is further added to the content of th register 224. In consequence, the content of the register 223 becomes "h+i" while the content of the register 224 becomes "α+2h+i". Subsequently, the same operation is repeated, so that the data within the register 224 is changed curvilinearly as shown in FIG. 30 part (G), thereby performing a visual display on the basis of such data.

(iv) Step Change Display

It is assumed here that the color data CDr is changed in a stepped manner by an amount equivalent to Di "10010000" at the dot DoM between the dots DoK and DoL shown in FIG. 18. In this case, the VRAM 305 is arranged to store:

Dr="1001"
Da="5"

as the display data corresponding to the dot DoM. This arrangement forces the multiplexer 236 to output the data "Di" when the display data corresponding to the dot DoM is read from the VRAM 305. Incidentally, it is assumed that the flip-flop 316 of FIG. 25 is reset. This data Di is supplied to the adder circuit 242 in which it is added to the content of the register 224. The result of this addition is read by the register 224. In consequence, the displayed color is changed in a stepped manner at the dot DoM. It should be noted that this step change display can be applied to the constant shading or the curvilinear interpolation shading in addition to the linear interpolation shading.

(v) Double-precision display

The double-precision display is the operation by which each dot is displayed on the basis of the 8-bit color data CDr. It should be noted that, although the above-described display examples adopt the 8-bit color data CDr, the dots DoK, DoM shown in FIG. 12 and the dot DoK shown in FIG. 13 serving as reference dots are substantially displayed on the basis of the 4-bit color data CDr, the lower-order 4 bits being "0"s. In contrast, according to this double-precision display, the above noted reference dots can be displayed on the basis of the full 8-bit color data CDr As an example, it is assumed here that the dot DoK shown in FIG. 13 is displayed on the basis of the color data CDr [B7] (hexadecimal number). In this case, the VRAM 305 is arranged to store the following display data:

the display data corresponding to the dot Do (K−1)
Dr=7
Da=0; and
the display data corresponding to the dot DoK
Dr=B,
Da=6.

The process of display operation in this case will be described with reference to the timing chart shown in FIG. 31. It is assumed here that, at a time t0 shown in the Figure, the VRAM 305 outputs the display data corresponding to the dot Do (K−1) and, at a time t1, the VRAM 305 outputs the display corresponding to the dot DoK. In this case, the output of the register 321 assumes the state shown by part C of FIG. 31, while the output of the register 325 assumes the state shown by part D of the same Figure. The signal C6 goes to a "1" signal between times t2 and t3 (FIG. 31, part (E)). When the signal C6 goes to a "1" signal between the times t2 and t3, the output "7" of the register 325 is supplied to the lower-order 4 bits of the input terminal <I> of the multiplexer 237 through the multiplexer 339. In the meantime, the output "B" of the register 321 is supplied to the higher-order 4 bits of the multiplexer 237. In addition, at this time, the output of the OR gate 329 goes to a "1" signal, and this "1" signal is supplied to the control terminal C of the multiplexer 237. In consequence, between the times t2 and t3, the multiplexer 237 outputs the data "B7" (see part G in FIG. 31), supplying it to an input terminal of the register 224. Subsequently, when the dot clock φ is output at the time t3, the data "B7" is read by the register 224 (see part H in FIG. 31), and the thus-read data "B7" is output through the multiplexer 238 in the form of the color data CDr. Thus, the dot DoK is displayed in color on the basis of this color data CDr "B7". It should be noted that the timing at which the color data CDr "B7" is output by the multiplexer 238 is selected so as to be two cycles of the dot clock φ after the time when the VRAM 305 outputs the display data corresponding to the dot DoK.

When the dot DoK is to be displayed with double precision in the above-described manner, the VRAM 305 is arranged to store the lower-order 4 bits of the color data CDr and the attribute data Da "0" as the display data corresponding to the preceding dot Do (K−1), and to store the higher-order 4 bits of the color data CDr and the attribute data Da "6" as the display data corresponding to the dot DoK.

The above description has been made with respect to the double-precision display. As a matter of course, such double-precision display can be combined with each of the display modes described previously. As an example, it is possible to display all dots between the dots DoK and Do (M−1) on the basis of color data CDr "αβ" (the constant shading) if the VRAM 305 is arranged to store the following display data:

the display data corresponding to the dot Do (K−1) shown in FIG. 12
Dr=β,
Da=0;
the display data corresponding to the dot DoK
Dr=α,
Da=6; and
the display data corresponding to the dots between the dots Do (K+1) and Do (M−1)
Dr=0,
Da=0.

In addition, if the VRAM 305 is arranged to store the following display data, it is possible to display the dot DoK of FIG. 13 on the basis of the color data CDr "B7", and also to display the dots between the dots Do (K+1) and DoL by linear interpolation shading:

the display data corresponding to the dot Do (K−1) shown in FIG. 13
Dr=7,
Da=0;
the display data corresponding to the dot DoK
Dr=B,
Da=6;

the display data corresponding to the dot Do (K+1)
Dr=Δ
Da=4; and
the display data corresponding to the dots between the dots Do(K+2) and DoL
Dr=0,
Da=0.

Figure 31:
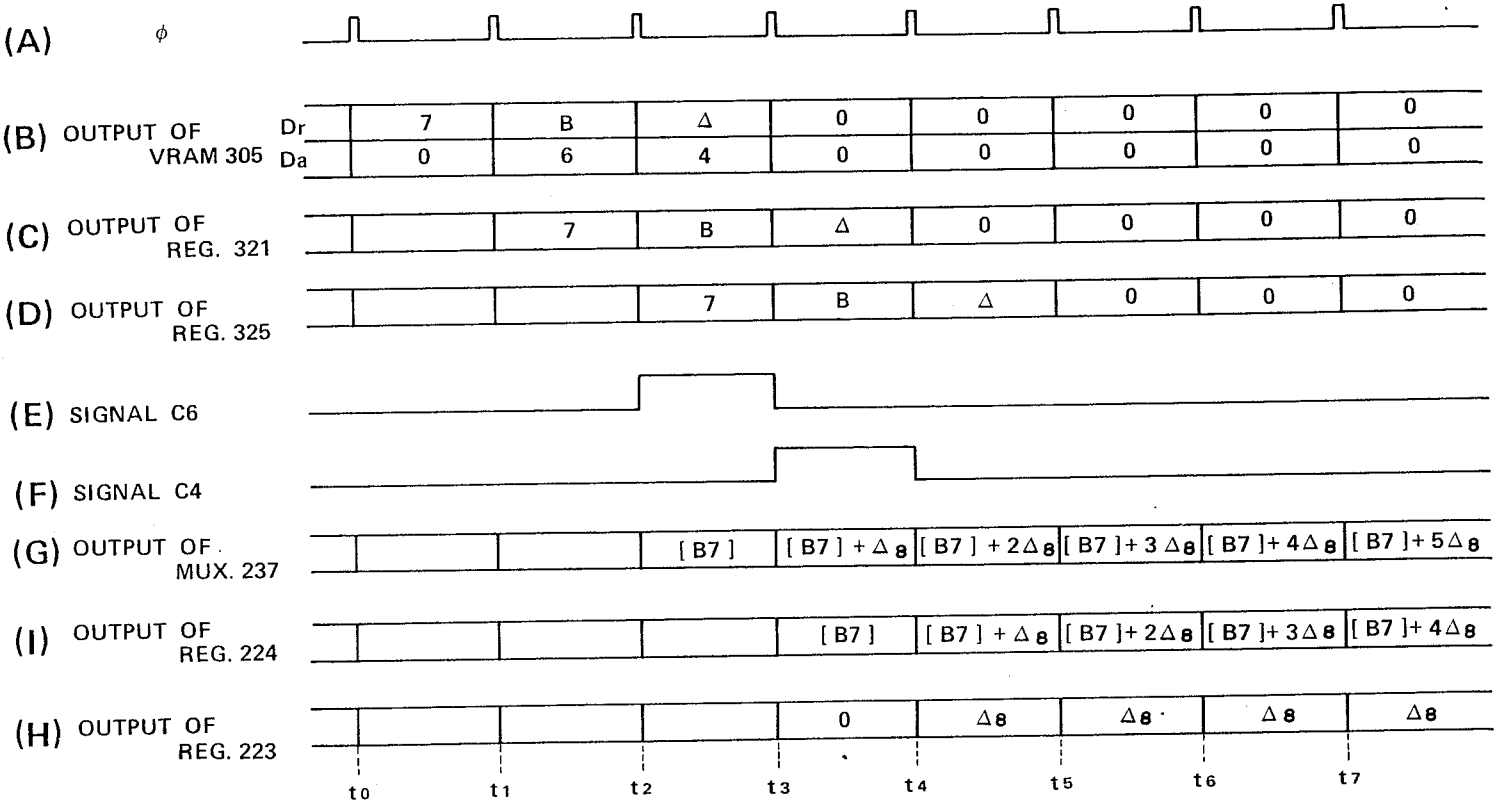
FIG. 31 is a timing chart showing the relationship between the display data which are read from the VRAM 305 of FIG. 23 and variations in the signal generated in the data modifier circuit 312*r* of FIG. 26 and in the outputs of associated registers, when the Phong Shading is to be effected with double precision.

Incidentally, FIG. 31 is a timing chart of the above-described display example.

In the above-described display example, if the dot Do (K+2) is displayed on the basis of the display data such as $Dr=\Delta^2$, Da=7, the section between the dots Do (K+1) and DoL can be displayed by curvilinear interpolation shading.

In the above-described case of "double-precision display+linear interpolation shading", the flip flop 316 of FIG. 25 is set after the passage of one cycle of the dot clock $\phi$ after the time when the VRAM 305 outputs the display data corresponding to the dot DoK. In this state, if the VRAM 305 is arranged to store the following display data, the color data CDr corresponding to the dot DoM is changed in a stepped manner by an amount equivalent to "$\delta\gamma$" with respect to the color data Dr corresponding to the dot Do (M−1) (Step Change Display):

the display data corresponding to the middle dot Do (M−1) between the dots DoK and DoL
Dr=$\gamma$
Da=0; and
the display data corresponding to the dot DoM
Dr=$\delta$
Da=5.

In this fashion, the double-precision display can be combined with each of the above-described display modes.

(vi) Direct Display

The direct display is the displaying method by which dots are displayed on the basis of the color data CDr merely having the R data Dr within the VRAM 305 as the higher-order 4 bits and the data "0" as the lower-order 4 bits.

In this display mode, the higher-order 4 bits of color data are stored as the R data Dr in each of the storage areas E of the VRAM 305, a "1" being stored as the attribute data Da. According to this manner of data storage, while an image is being displayed, the R data Dr which is sequentially supplied by the VRAM 305 is stored in the register 325 through the register 321. The data which is stored in the register 325 is supplied to the higher-order 4 bits of the input terminal <I> of the multiplexer 238. In consequence, since the signal D1 goes to a "1" signal, the multiplexer 238 outputs the color data CDr having the R data Dr as the higher-order 4 bits and the data "0" as the lower-order 4 bits.

The above detailed description has been made with respect to the fifth preferred embodiment of the present invention. In the above-described fifth embodiment, since a double-precision display can be performed, it is possible to display an image on the basis of the 8-bit color data CDr, CDg and CDb by storing the R, G and B data Dr, Dg and Db in 4-bit form in the VRAM 305. Specifically, an image can be display in $2^{24}$ colors. It should be noted that, in the above-described fifth embodiment, the second-order factor $\Delta^2$ is applied to the lower-order 4 bits of the multiplexer 233. This is because the second-order factor $\Delta^2$ could be selected from the group of relatively small values in practical terms. In addition, the first-order factor Δ is applied to the second to fifth bits of the multiplexer 235. This is because a value somewhat larger than the second-order factor is normally selected as the first-order factor.

What is claimed is:

1. An image display apparatus for use with a color display unit responsive to a plurality of color signals, and for displaying a color graphic image having at least one region defined by boundaries and being composed of a plurality of display dots whose colors are determined respectively by the color signals, said image display apparatus comprising:

(a) storage means for storing a plurality of display data corresponding to said boundaries of said region of said color graphic image, each display data including color data relating to a color of one of the plurality of display dots and attribute data representative of an attribute of said each display data;

(b) readout means for selectively reading said plurality of display data one by one from said storage means in synchronization with a display timing of each of the display dots on the color display unit;

(c) data modifier means responsive to the display data read from said storage means, and for performing a data-modifying operation on the color data corresponding to said boundaries so as to provide the color data of the display dots composing said region of said color graphic image, said data-modifying operation being determined by the attribute data of said read display data and involving the color data corresponding to said boundaries so as to provide the color data of the display dots composing said region of the color graphic image to be displayed on the color display, said data modifier means outputting the result of said data-modifying operation; and (d) signal feeding means for feeding the result of said data-modifying operation outputted from said data modifier means to the color display unit as the color signal.

2. An image display apparatus according to claim 1, wherein said storage means is a video memory which stores said plurality of display data so that each of said plurality of display data corresponds to a respective one of the plurality of display dots, said readout means sequentially reading each of said plurality of display data from said video memory in synchronization with a respective one of the display dots on the color display unit.

3. An image display apparatus according to claim 1 further comprising a video memory for storing a plurality of color codes each representing a color of a respective one of the plurality of display dots on the color display unit, wherein said storage means is a look-up table means which stores said plurality of display data, said readout means sequentially reading each of said color codes from said video memory in synchronization with the display timing of a respective one of the plurality of display dots on the color display unit, said readout means further selectively reading the plurality of display data one by one from said look-up table in accordance with each of the color codes read from the video memory.

4. An image display apparatus according to claim 2, wherein said signal feeding means comprises converter means for converting luminance data Y and color-difference data U and V into a color signal, each display data stored in said storage means including luminance data Y and color-difference data U and V which represent a color of a respective one of the plurality of display dots on the color display unit, said data modifier means supplying the result of said data modifying operation to said signal feeding means as said luminance data Y and color-difference data U and V to be converted by said converter means, said converter means outputting the conversion result to the color display unit as the color signal.

5. An image display apparatus according to claim 1, wherein said signal feeding means comprises a digital-to-analog converter means for converting the result of said operation outputted from said data modifier means into an analog signal and for outputting said analog signal to the color display unit as the color signal.

6. An image display apparatus according to any one of claims 1 to 5, wherein said data modifier means comprises a first register for storing the color data of the display data read from said storage means when the attribute data of said read display data represents a first predetermined value, and adder means for adding the color data of the display data read from said storage means to data stored in said register when the attribute data of said read display data represents a second predetermined value, said data modifier means outputting data contained in said register as the result of said data-modifying operation.

7. An image display apparatus according to any one of claims 1 to 5, wherein said data modifier means comprises:

a first register for storing the color data of the display data read from said storage means when the attribute data of said read display data represents a first predetermined value;

a second register for storing the color data of the display data read from said storage means when the attribute data of said read display data represents a second predetermined value; and first operation means for effecting a first operation on data stored respectively in said first and second registers to obtain an operation result and for storing the result of said first operation into said first register when the attribute data of said read display data represents a third predetermined value;

said data modifier means outputting data contained in said first register to said signal feeding means as an output of said data modifier means.

8. An image display apparatus according to claim 7, wherein said data modifier means further comprises:

a third register for storing the color data of the display data read from said storage means when the attribute data of said read display data represents a fourth predetermined value; and second operation means for effecting a second operation on data stored respectively in said second and third registers to obtain an operation result and for storing the result of said second operation into said second register when the attribute data of said read display data represents a fifth predetermined value.

9. An image display apparatus according to any one of claims 1 to 5, wherein said data modifier means comprises:

a first register for storing the color data of the display data read from said storage means when the attribute data of said read display data represents a first predetermined value; and combining means for combining therewithin the color data of the display data read from said storage means with data precedingly stored therein in a bit shifted relation when the attribute data of said read display data represents a second predetermined value;

said data modifier means outputting data contained in said combining means, to said signal feeding means as an output of said data modifier means.

10. An image display apparatus according to claim 6, wherein said data modifier means further comprises:

a second register for storing the color data of the display data read from said storage means when the attribute data of said read display data represents a third predetermined value; and means for combining the color data of the display data read from said storage means with data stored in said second register in a bit-shifter relation when the attribute data of said read display data represents a fourth predetermined value, and for storing said first combined data into said register.

11. An image display apparatus according to claim 7, wherein said data modifier means further comprises:

a third register for storing the color data of the display data read from said storage means when the attribute data of said read display data represents a fourth predetermined value; and means for combining the color data of the display data read from said storage means with data stored in said third register in a bit-shifted relation when the attribute data of said read display data represents a fifth predetermined value, and for storing said combined data into said first register.

12. An image display apparatus according to claim 8, wherein said data modifier means further comprises:

a fourth register for storing the color data of the display data read from said storage means when the attribute data of said read display data represents a sixth predetermined value; and means for combining the color data of the display data read from said storage means with data stored in said fourth register in a bit-shifted relation when the attribute data of said read display data represents a seventh predetermined value, and for storing said combined data into said first register.

13. An image display apparatus for use with a color display unit responsive to a plurality of color signals, and for displaying a color graphic image having at least one region defined by boundaries and being composed of a plurality of display dots whose colors are determined respectively by the color signals, said image display apparatus comprising:

(a) storage means for storing a plurality of display data corresponding to said boundaries of said region of said color graphic image, each display data including color data relating to a color of one of the plurality of display dots and attribute data representative of an attribute of said each display data;

(b) readout means for selectively reading said plurality of display data one by one from said storage means in synchronization with a display timing of each of the display dots on the color display unit;

(c) data modifier means responsive to the display data read from said storage means, and for performing a data modifying operation on the color data corresponding to said boundaries so as to provide the color data of the display dots composing said region of said color graphic image, said color data of the display dots composing said region having a shade of color determined by interpolation of color data corresponding to said boundaries or corresponding to said boundaries and interpolated color data within said region defined thereby, said data-modifying operation including said color data interpolation and being determined by the attribute data of said read display data and involving the color data corresponding to said boundaries so as to provide said shaded color data of the display dots composing said region of the color graphic image to be displayed on the color display, said data modifier means outputting the result of said data-modifying operation; and (d) signal feeding means for feeding the result of said operation outputted from said data modifier means to the color display unit as the color signal.

14. The image display apparatus of claim 13, wherein said data modifier means further comprises means for carrying out linear interpolation of said color data of said boundaries and interpolation color data of said region, so as to provide a constant rate of color variation between said display dots composing said region defined by said boundaries.

15. The image display apparatus of claim 13, where in said data modifier means further comprises means for carrying out curvilinear interpolation of said color data of said boundaries and interpolated color data corresponding to said region, so as to provide non-constant rate of color variation between said display dots comprising said region defined by said boundaries.

* * * * *